US011180299B1

(12) United States Patent
Montejo

(10) Patent No.: US 11,180,299 B1
(45) Date of Patent: Nov. 23, 2021

(54) ROTATABLE MULTIPOSITIONAL FASTENERS

(71) Applicant: Raul E. Montejo, Fort Pierce, FL (US)

(72) Inventor: Raul E. Montejo, Fort Pierce, FL (US)

( * ) Notice: Subject to any disclaimer, the term of this patent is extended or adjusted under 35 U.S.C. 154(b) by 49 days.

(21) Appl. No.: 16/597,784

(22) Filed: Oct. 9, 2019

(51) Int. Cl.
*B65D 63/14* (2006.01)
*B65D 63/10* (2006.01)

(52) U.S. Cl.
CPC ..... *B65D 63/14* (2013.01); *B65D 63/1063* (2013.01)

(58) Field of Classification Search
CPC .... B65D 63/14; B65D 63/1063; B65D 63/12; B65D 63/16; F16L 3/2334; Y10T 24/1498; Y10T 24/153
See application file for complete search history.

(56) References Cited

U.S. PATENT DOCUMENTS

| | | | | |
|---|---|---|---|---|
| 1,378,753 | A | 5/1921 | Zwiling | |
| 2,650,590 | A | 9/1953 | Leroy | |
| 3,250,505 | A * | 5/1966 | Rodman, Sr. | F16L 3/233 248/49 |
| 3,570,554 | A | 3/1971 | Kabel | |
| 3,654,669 | A | 4/1972 | Fulton | |
| 3,970,331 | A | 7/1976 | Giulie | |
| 4,071,023 | A | 1/1978 | Gregory | |
| 4,422,217 | A | 12/1983 | Barette | |
| 4,498,507 | A | 2/1985 | Thompson | |
| 4,665,588 | A | 5/1987 | Nakano | |
| 4,862,560 | A | 9/1989 | Lichtenberg | |
| 4,910,831 | A | 3/1990 | Bingold | |
| 4,993,669 | A | 2/1991 | Dyer | |
| 5,088,158 | A | 2/1992 | Burkholder | |
| 5,102,075 | A | 4/1992 | Dyer | |
| 5,119,528 | A | 6/1992 | Ono et al. | |
| 5,121,524 | A | 6/1992 | Mortensen | |
| 5,159,728 | A | 11/1992 | Bingold | |
| 5,193,251 | A | 3/1993 | Fortsch | |
| 5,226,360 | A | 7/1993 | Kramka | |
| 5,234,245 | A | 8/1993 | Peterson et al. | |
| 5,257,870 | A | 11/1993 | Bennett et al. | |
| D347,156 | S | 5/1994 | Starrett et al. | |

(Continued)

*Primary Examiner* — Robert Sandy
*Assistant Examiner* — Rowland Do
(74) *Attorney, Agent, or Firm* — Brian S. Steinberger; Hilary F. Steinberger; Law Offices of Brian S. Steinberger, P.A.

(57) ABSTRACT

Rotatable multipositional fasteners, devices, systems and methods having fastener receivers attachable and detachable by male and female parts. Each receiver can receive plural ends of straps, such as zip ties, having greater versatility than existing fastening systems. The multi-positional disposition of adjacent rotatable receivers facilitates the reception by the receivers of straps from multiple angles, elevations, and directions. Greater possibilities of proximity between the straps and the receivers can be due to the multiple possible orientations and flexible movement of the receivers. Proximal positioning creates a more aligned, linear connection between corresponding receivers and straps, resulting in reduced stress on the straps. Each receiver can have a plural openings where the insertion ends of the straps are inserted and fastened. A fastening mechanism in the openings of the housing locks with a strap end to form the fastened closure. Other openings in the housing allow for a strap to pass through both sides of the housing.

16 Claims, 29 Drawing Sheets

(56) References Cited

U.S. PATENT DOCUMENTS 5,398,383 A 3/1995 Bingold
5,443,155 A 8/1995 Robinson
D372,099 S 7/1996 Troy et al.
5,538,208 A * 7/1996 Cordes ..... F16L 3/233 248/68.1
5,544,391 A 8/1996 Hoffman
5,651,376 A 7/1997 Thompson
5,758,390 A 6/1998 Villeneuve
5,802,675 A 9/1998 Parsons
5,802,888 A 9/1998 Parsons
5,988,925 A 11/1999 Baggett
6,128,809 A 10/2000 Khokhar
6,196,033 B1 3/2001 Dowdle
6,227,399 B1 5/2001 Angus et al.
6,240,602 B1 6/2001 Geiger
6,364,257 B1 4/2002 Holder
6,507,979 B1 1/2003 Thompson
6,532,631 B2 3/2003 Rohaly et al.
6,718,597 B2 * 4/2004 Geiger ..... B65D 63/1072 24/16 PB
6,793,435 B2 9/2004 Higashino et al.
6,807,715 B1 10/2004 Blair
6,845,577 B1 1/2005 Downes
6,961,979 B2 11/2005 Wendle
7,120,968 B2 10/2006 Huene et al.
7,131,168 B2 11/2006 Pangalto
7,207,740 B1 4/2007 Baggett
7,243,399 B2 7/2007 Liao
7,437,804 B1 10/2008 Geiger et al.
7,770,852 B2 * 8/2010 Caveney ..... F16B 19/02 248/68.1
7,789,414 B2 9/2010 Blackburn
7,882,599 B2 2/2011 Harrington
7,934,296 B2 5/2011 Okamoto
8,387,215 B2 3/2013 Koncelik, Jr.
8,474,104 B2 7/2013 Watson
8,739,387 B1 6/2014 Frishberg
8,978,210 B2 3/2015 Arjomand
8,978,211 B2 3/2015 Arjomand
9,038,246 B2 5/2015 Liang
9,067,717 B2 6/2015 DeMik et al.
D739,714 S 9/2015 Geiger et al.
9,321,571 B2 4/2016 Griggio
D756,203 S 5/2016 Kelleghan
9,328,539 B1 5/2016 Lonardo et al.
9,637,291 B2 5/2017 Montejo
2002/0071715 A1 * 6/2002 Geiger ..... H02G 11/00 403/119
2003/0074821 A1 4/2003 Goodin et al.
2005/0076478 A1 4/2005 Miyazaki et al.
2006/0244244 A1 11/2006 Blackburn
2007/0067965 A1 3/2007 Sugiyama
2007/0119030 A1 5/2007 Hoffman et al.
2007/0234524 A1 10/2007 Witt
2008/0276432 A1 11/2008 McNeill
2009/0077773 A1 3/2009 Harrington et al.
2011/0131768 A1 6/2011 Watson
2011/0194908 A1 8/2011 Collins et al.
2011/0314641 A1 12/2011 Sun
2012/0272485 A1 11/2012 Liang
2015/0033509 A1 2/2015 Dietrich
2015/0368015 A1 12/2015 Steinman
2016/0001945 A1 1/2016 Foreman et al.
2016/0325897 A1 11/2016 Kierstead
2017/0050787 A1 * 2/2017 Bart ..... B65D 63/1063

* cited by examiner

ROTATABLE MULTIPOSITIONAL FASTENERS

FIELD OF INVENTION

This invention relates to rotatable multipositional fasteners, and in particular to fasteners, systems, devices, and methods for providing rotatable receivers that are attachable and detachable with one another by male and female parts, wherein each receiver can receive plural ends of straps, such as zip ties together, having greater versatility than existing fastening systems for straps, such as zip ties, and the like.

BACKGROUND AND PRIOR ART

Fastening straps such as zip ties are often configured to securely retain multiple items together in a bundle or hang the item from a mounting surface. Because of their low cost and ease of use, zip ties are ubiquitous, finding use in a wide range of other applications. The zip tie generally uses a closure at one end and an insertion tab at the opposite end.

By observation, the subject inventor was aware that multiple wires, tubes, and linear items were often retained and guided with a strap and a closure fastener that secured the insertion tab of the strap into a closed loop around the items. The inventor saw that, often, the items being retained within the straps were complex combinations of wires and pipes that required segregated bundling. This wiring would often have to pass through numerous channels and bend around corners. The strap holding the wiring would be oriented in multiple directions, angles, and elevations. This made fastening the strap with a closure fastener difficult. One specific example the inventor knew about was aircraft wiring.

However, since the straps and wiring arrived at the closure fastener from multiple dispositions, they often wore down and broke after chaffing and frictional engagement with other surfaces. The chaffing can also occur as the straps and fastening closures were fastened into closure at odd angles, which created great stress on the straps and wires.

Additionally, the straps often passed around corners and through tight channels, which created greater stress.

It is generally believed that a common zip tie, is often made of nylon, has a tape section with teeth that engage with a pawl in the head to form a ratchet so that as the free end of the tape section is pulled the tie-wrap tightens and does not come undone. Another version of the tie-wrap allows a tab to be depressed to either adjust the tension or remove the ty-wrap.

It is the understanding of the inventor that the most common zip tie includes a sturdy nylon tape with an integrated gear rack, and on one end a ratchet within a small open case. The inventor recognized that once the pointed tip of the cable tie has been pulled through the case and past the ratchet, it is prevented from being pulled back; the resulting loop may only be pulled tighter.

It is the understanding of the inventor that a cable tie tensioning tool could be used to apply the zip tie with a specific degree of tension. The tool can cut off the extra tail flush with the head in order to avoid a sharp edge which might otherwise cause injury.

However, the inventor recognized that the angle of engagement between the closure fastener and the tab at the terminus of the zip tie were often oriented in different directions. This created stress on the zip tie as it attempted to loop around the wires and fasten the closure closed. As a result, the diameter of formed loop, length, angle of orientation for a typical zip tie was limited. For example, to create a larger loop required the inventor to stretch the zip tie. Or to change directions of the connection around bulky objects was problematic.

The inventor decided that, rather than to redesign the zip tie, he would construct a multiple closure fastener that oriented in slightly different angles and elevations. This created more entry options for the insertion tab of the zip tie. The straps were then wrapped around the wires using this configuration of closure fasteners.

However, the inventor saw that there was still stress on the zip tie. The inventor recognized that greater flexibility was needed between adjacent closures. Through trial and error, the inventor learned that by cutting a small wedge between adjacent closures, they could be made to pivot relative to each other. This pivoting, lateral motion formed more entry options for the closure at various angles and orientations with the closures. The inventor finally developed a tensioning cutting member that smoothly cut either end of the zip tie through tension.

Zip ties have been used for economically and efficiently mounting objects and bundling items in the past, yet none with the present characteristics of the present invention. See patent numbers: U.S. 2012/0272485 Liang; U.S. Pat. No. 5,758,390 to Villeneuve; and U.S. Pat. No. 8,739,387 to Frishberg.

For the foregoing reasons, there is a need for a multi-positional closure fasteners, systems, devices and methods that provide for fastening a plurality of multi-directional straps to bundle together or mount items while minimizing stress on the straps.

Thus, the need exists for solutions to the above problems with the prior art.

SUMMARY OF THE INVENTION

A primary objective of the present invention is to provide fasteners, systems, devices, and methods for providing rotatable receivers that are attachable and detachable with one another by male and female parts, wherein each receiver can receive plural ends of straps, such as zip ties together, having greater versatility than existing fastening systems for straps, such as zip ties, and the like.

Multi-positional closure fasteners, systems, devices and methods disclosed are configured to create a relaxed, less stressful fastening closure for a plurality of straps used to bundle together and tie at least one item together. The fastener is configured to provide fastening closure to a plurality of straps that engage the fastener from multiple directions, angles, and elevations. The fastener is oriented, such that the straps are not stressed when engaging and fastening to the fastener.

The multi-positional closure fasteners, systems, devices and methods includes a plurality of receivers disposed adjacently to one another that can attach and detach from one another, and in nonplanar alignment with each other. The receivers can orient at different angles and elevations relative to each other. The receivers can include tapered sidewalls that enable a slight rotational motion between adjacent receivers. Furthermore, the receivers can have openings that face in the same or opposite directions.

The multi-positional and flexible disposition of the receivers facilitates a fastening engagement with a plurality of straps; and especially straps arriving from multiple directions and angles. This is because the orientation and general arrangement of the receivers provides greater possibilities of proximity with any one of the straps, due to the variously angled and elevated orientations, as well as the slight pivotal movement by the receivers. This proximal positioning creates a more aligned, linear engagement between corresponding straps and receivers, resulting in reduced stress on the straps.

Each receiver can be configured to receive and securely fasten to an insertion tab from a plurality of straps. The straps can be oriented to approach the proximity of the receivers from multiple directions and angles. Thus, in one embodiment, multiple insertion tabs from a plurality of straps can fasten to different receivers at an orientation that creates minimal stress on the straps. This more relaxed disposition of the straps relative to the receivers is possible because each receiver can orient more proximally to a corresponding strap tab due to their varying angles and elevations.

An embodiment of the rotatable multi-positional fastening system for fastening a plurality of multi-directional straps, can include a first receiver housing having a plurality of side walls, at last one side wall having an opening for receiving a strap end, and another side wall having an outwardly extending male portion, a second receiver housing having a plurality of side walls, at least one side wall having an opening for receiving another strap end, and another side wall having a female slot sized to receive the male portion of the first receiver, the second receiver housing oriented in a different plane than the first receiver housing, wherein the male portion of the first receiver is attachable and detachable from the female slot in the second receiver, so wherein the first receiver housing and the second receiver housing are initially rotatable to one another, and a fastening mechanism associated with each side wall opening in the first receiver housing the second receiver housing for respectively fastening the strap end and the another strap end.

The strap end and the another strap end can be strap ends of a plurality of straps. The plurality of straps can include zip ties.

The strap end and the another strap end can be ends of one strap. The one strap can be at least one zip tie.

The first receiver housing and the second receiver housing can include at least one tapered sidewall.

The first receiver housing and the second receiver housing, can each have a generally box shape.

The male portion of the first housing can include a base having a semi-hemispherical shape with a stem portion extending outwardly therefrom, the semi-hemispherical shape for allowing easy rotation of the first receiver and the second receiver housing relative to one another, when the first receiver housing is attached to the second receiver housing.

The female slot in the second receiver housing can include a bowl shape with a through hole in the bottom of the bowl shape for allowing a portion of the stem portion to pass therethrough and the hemispherical shape being able to rotate in the bowl shape.

The second receiver can include an arm with a clamp, wherein the clamp is attachable to wrap about a side groove on the stem portion, the clamp allowing the first receiver housing and the second receiver housing to remain attached to one another, and wherein removing the clamp from the side groove allows the first receiver housing and the second receiver housing to detach from one another.

The first receiver housing can be formed as single molded plastic part, and the second receiver housing is formed as a single molded plastic part.

The rotatable multi-positional fastening system can further include lock members for locking the first receiver housing to the second receiver housing in a selected rotated position.

The lock members can include a first ring on the sidewall of the first receiver housing, the first ring about the male portion, the first ring having raised protrusions and valleys between the raised protrusions. The lock members can include a second ring about the sidewall with the female slot on the second receiver housing, the second ring having raised protrusions and valleys between the raised protrusions, wherein the first receiver housing and the second receiver housing are initially oriented and rotated to a selected rotated position, followed by the first ring and the second ring are pushed against each other, and are locked together when the raised protrusions of the first ring are mateable with the valleys of the second ring, and the raised protrusions of the second ring are mateable with the valleys of the first ring.

The first receiver housing can further can include side openings on opposite side walls so that a strap can pass through both of the openings. The first receiver housing can further include a top opening on the first receiver housing opposite to the sidewall having the male portion extending therefrom.

The second receiver housing can include a second side opening on another side wall perpendicular to the female slot.

Another embodiment of the rotatable multi-positional fastening system for fastening a plurality of multi-directional straps can include two receivers disposed adjacently to one another, each receiver defined by a housing and at least one opening, a male part and a female part for attaching the two receivers together, and a fastening mechanism for attaching a portion of a strap to the at least one opening in each of the two receivers, wherein, the two receivers are at least initially rotatable with one another.

The male part can include a base having a semi-hemispherical shape with a stem portion extending outwardly therefrom, the semi-hemispherical shape for allowing easy rotation of the first receiver and the second receiver housing relative to one another, when the first receiver housing is attached to the second receiver housing.

The female part can include a bowl shape with a through hole in the bottom of the bowl shape for allowing a portion of the stem portion to pass therethrough, and the hemispherical shape being able to rotate in the bowl shape.

The system can further include a first ring on the sidewall of one of the two receivers, the first ring about the male part, the first ring having raised protrusions and valleys between the raised protrusions, and a second ring about the sidewall with the female part on another of the two receivers, the second ring having raised protrusions and valleys between the raised protrusions, wherein the two receivers are initially oriented and rotated to a selected rotated position, followed by the first ring and the second ring pushed against each other, and are locked together when the raised protrusions of the first ring are mateable with the valleys of the second ring, and the raised protrusions of the second ring are mateable with the valleys of the first ring.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

First Embodiment

Second Embodiment

Figure 16:
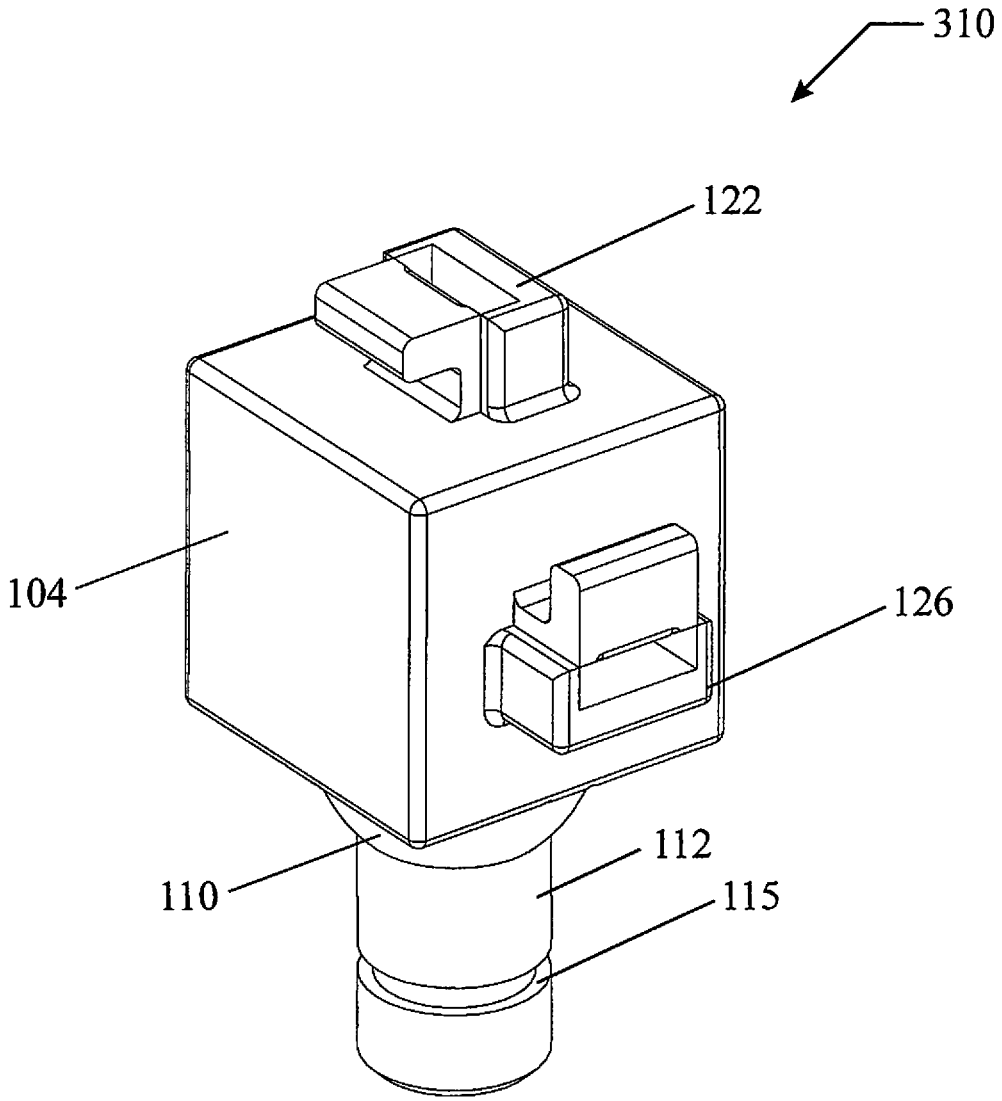

FIG. 16 is an upper front right perspective view of another male fastener of another rotatable multipositional fastener system.

Figure 17:
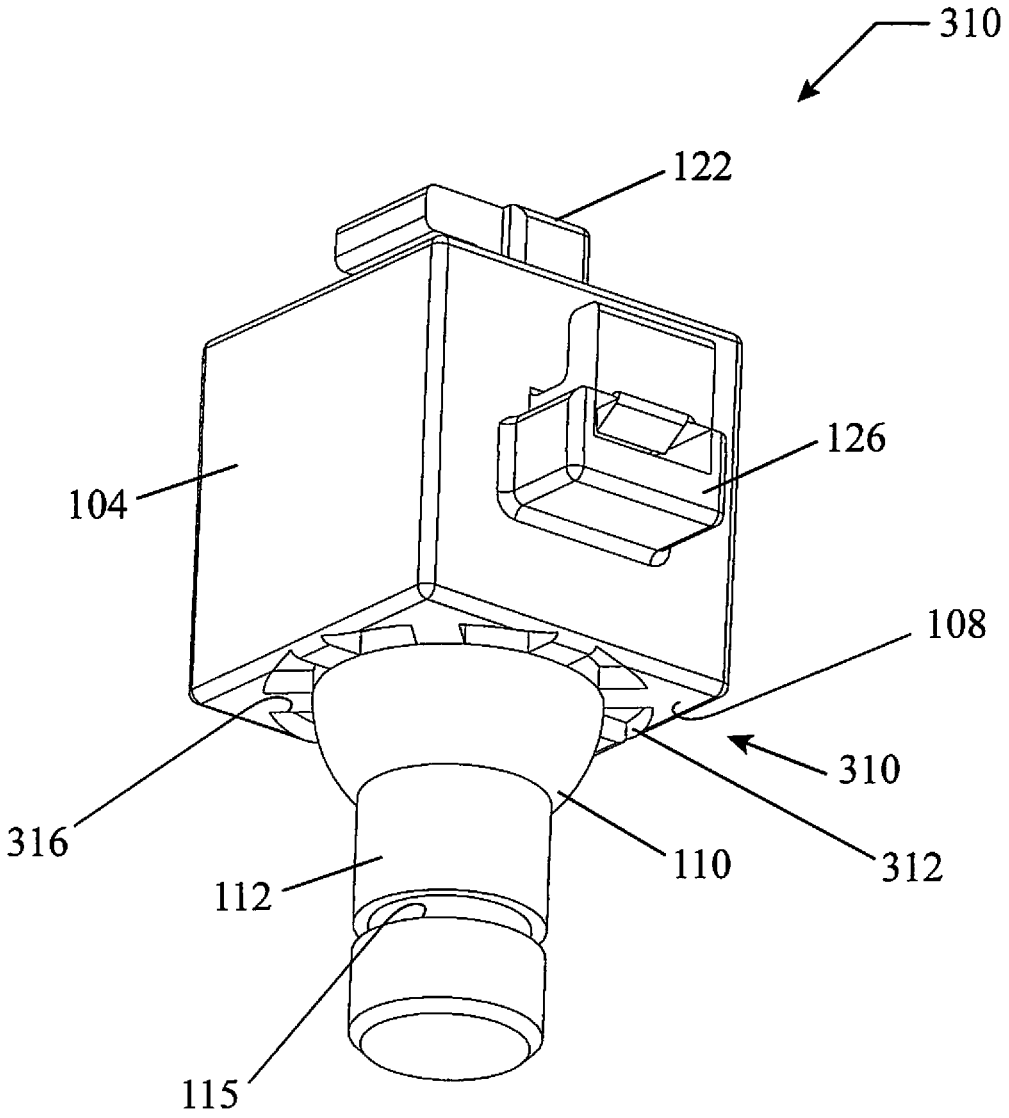

FIG. 17 is a lower front right perspective view of the male fastener of FIG. 16.

Figure 18:
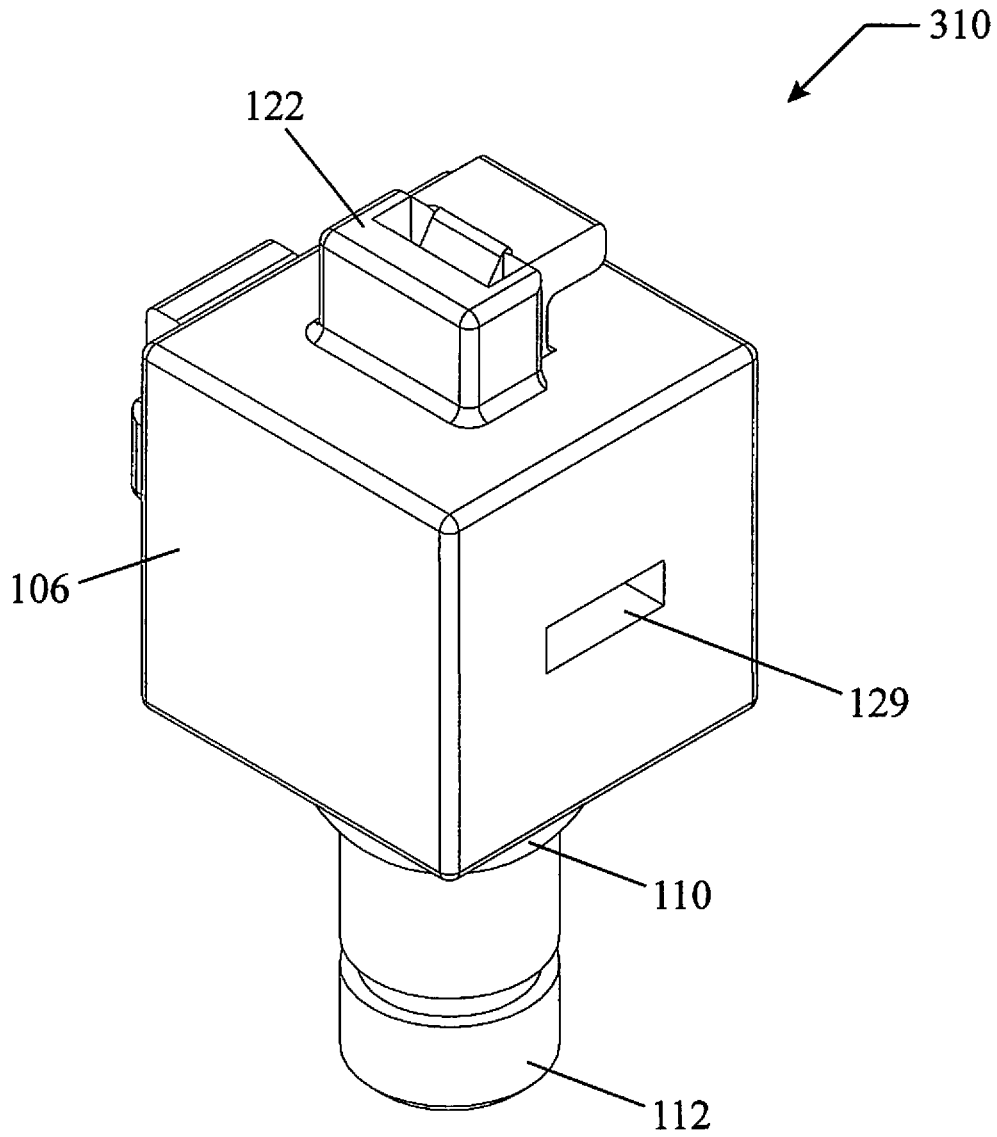

FIG. 18 is an upper rear right perspective view of the male fastener of FIG. 16.

Figure 19:
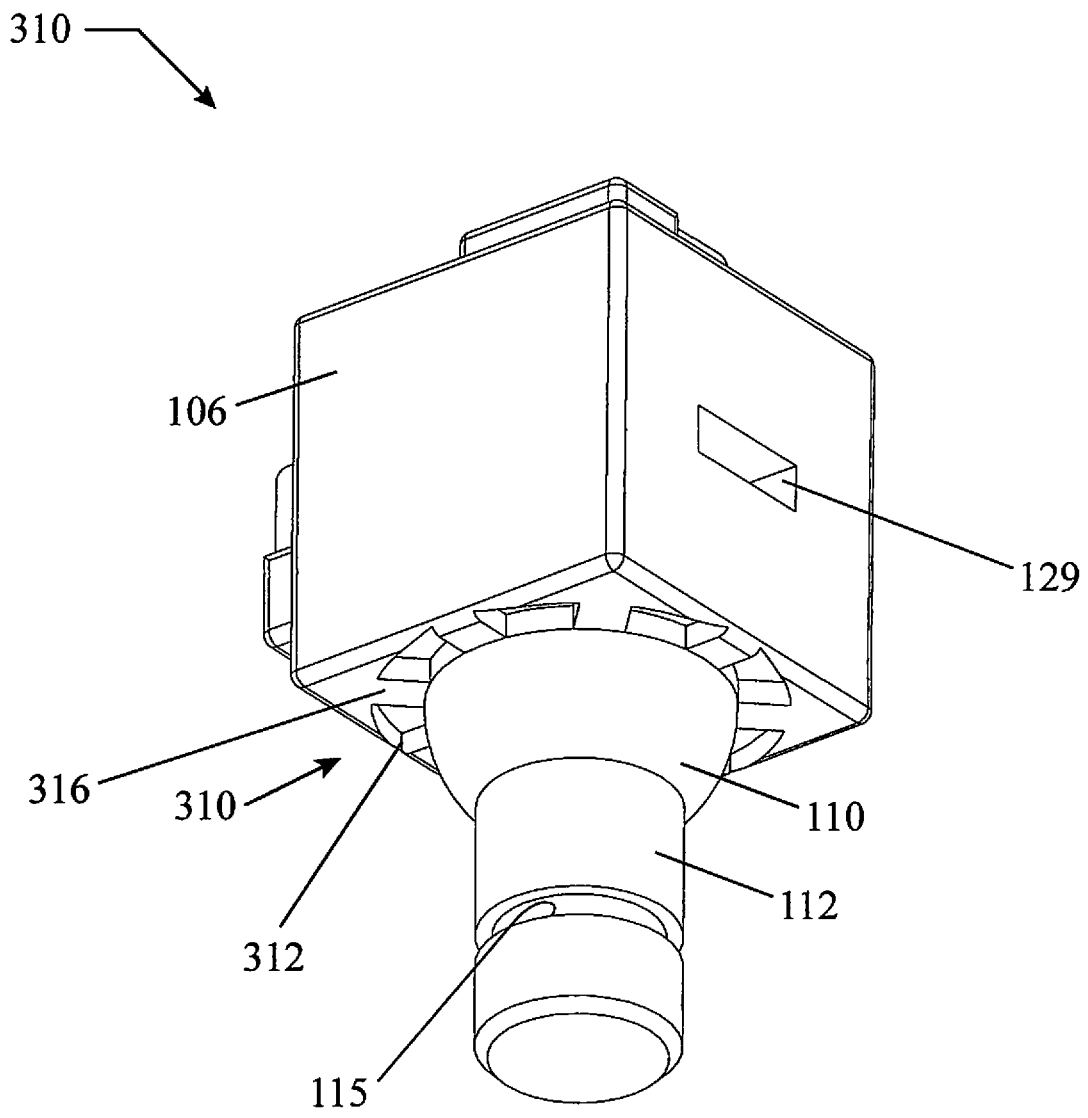

FIG. 19 is a lower rear right perspective view of the male fastener of FIG. 16.

Figure 20:
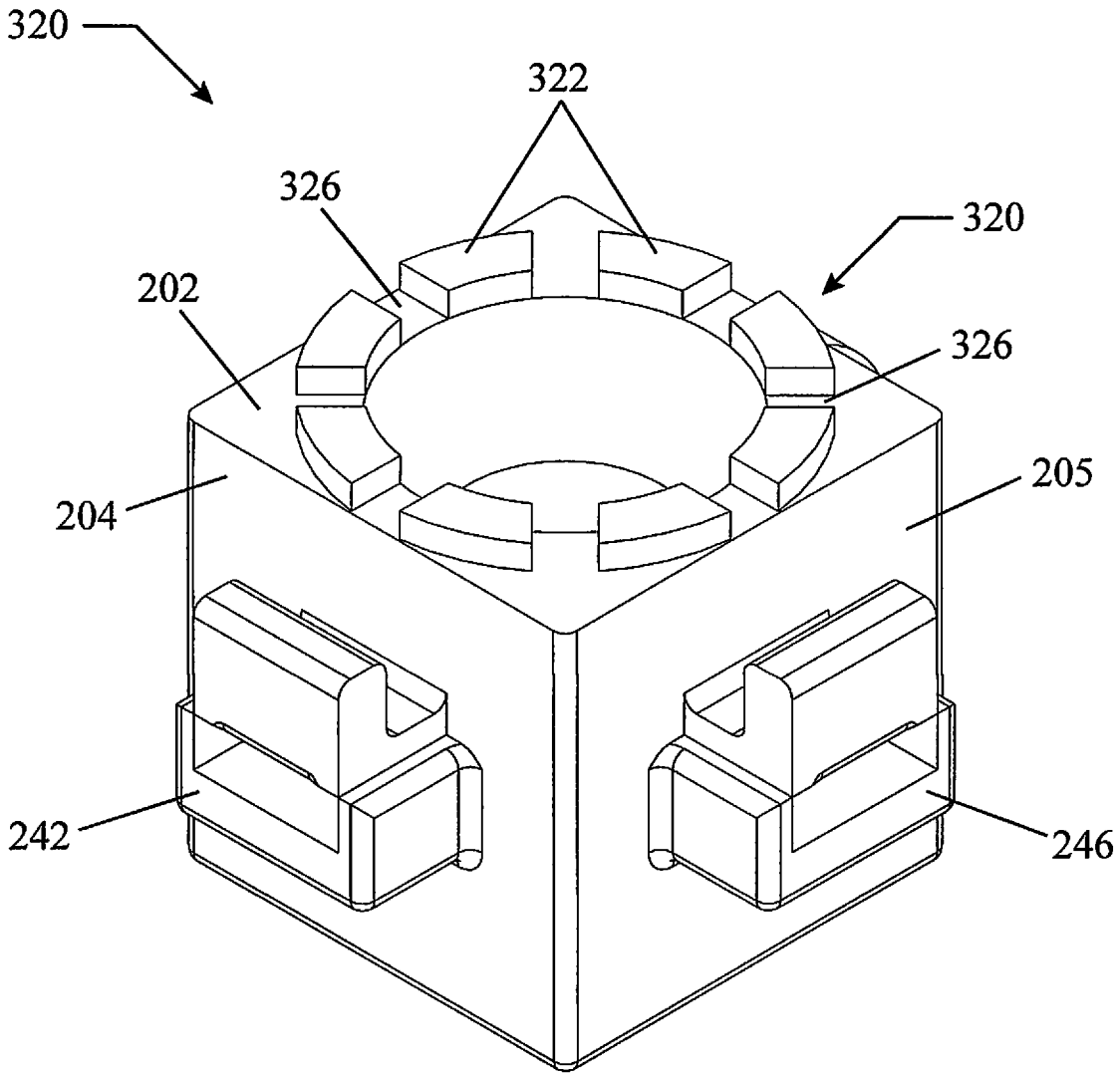

FIG. 20 is an upper front right perspective view of another female fastener of the rotatable multipositional fastener system used with the male fastener of FIG. 16.

Figure 21:
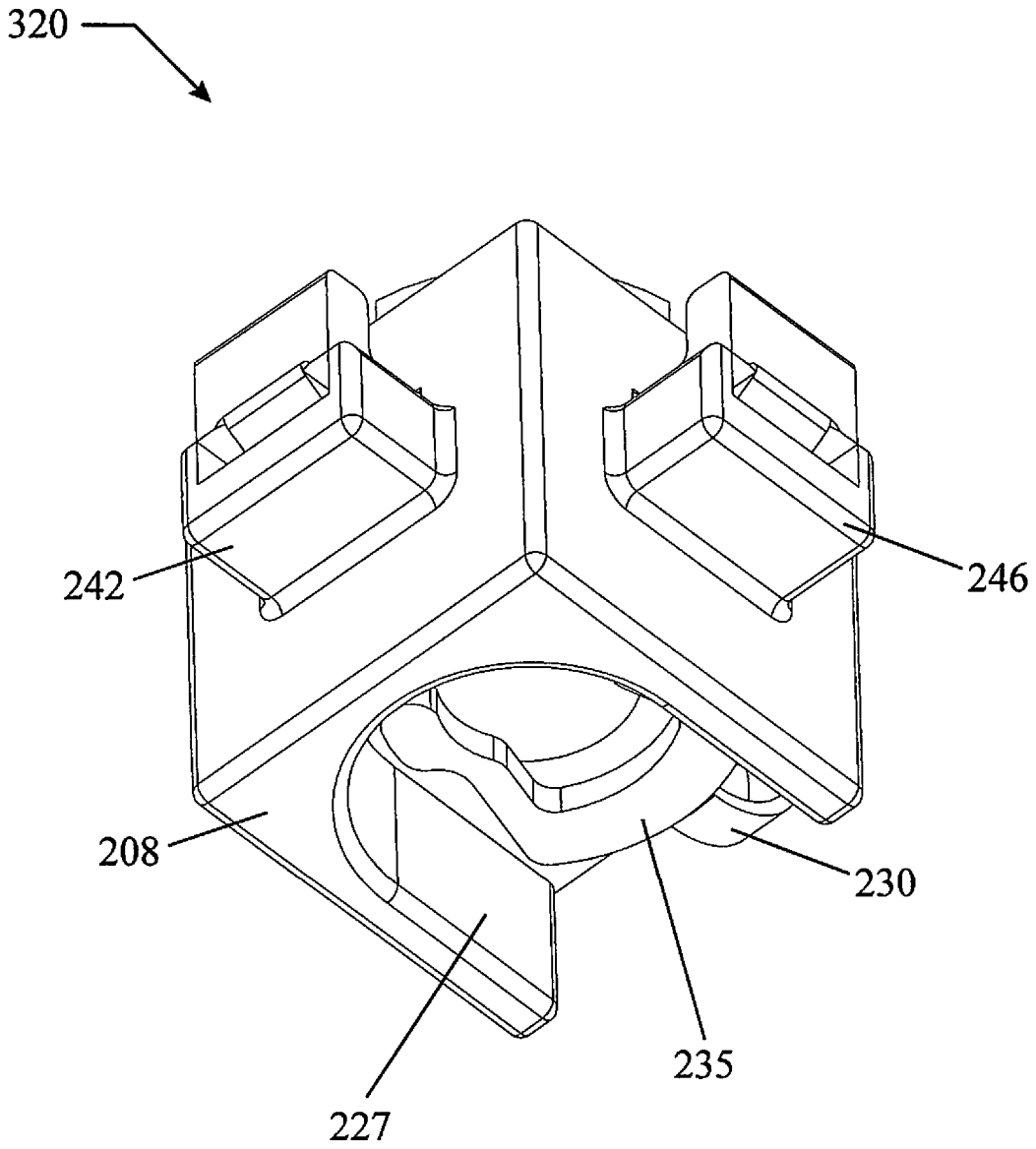

FIG. 21 is a lower front right perspective view of the female fastener of FIG. 20.

Figure 22:
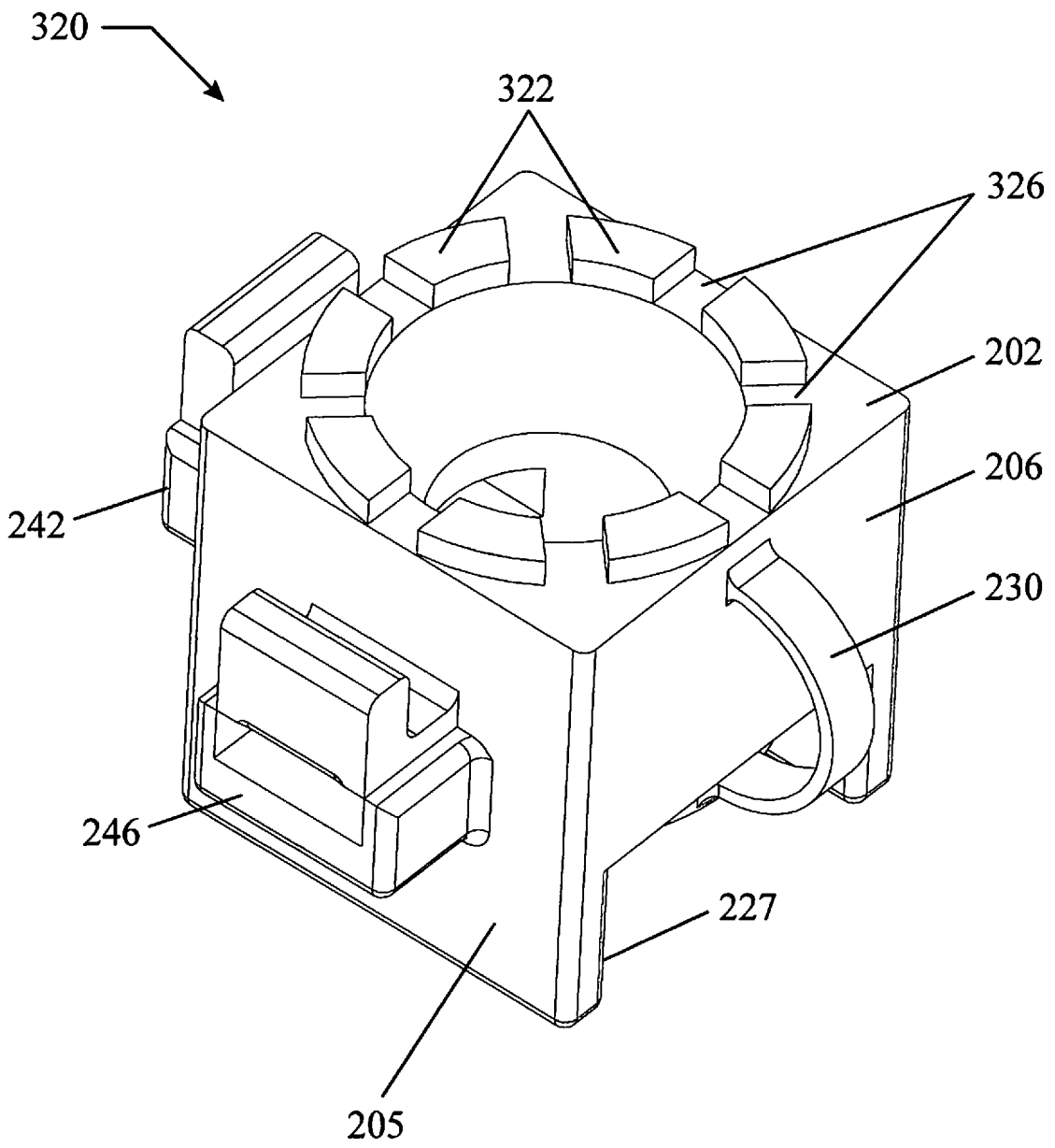

FIG. 22 is an upper right rear perspective view of the female fastener of FIG. 20.

Figure 23:
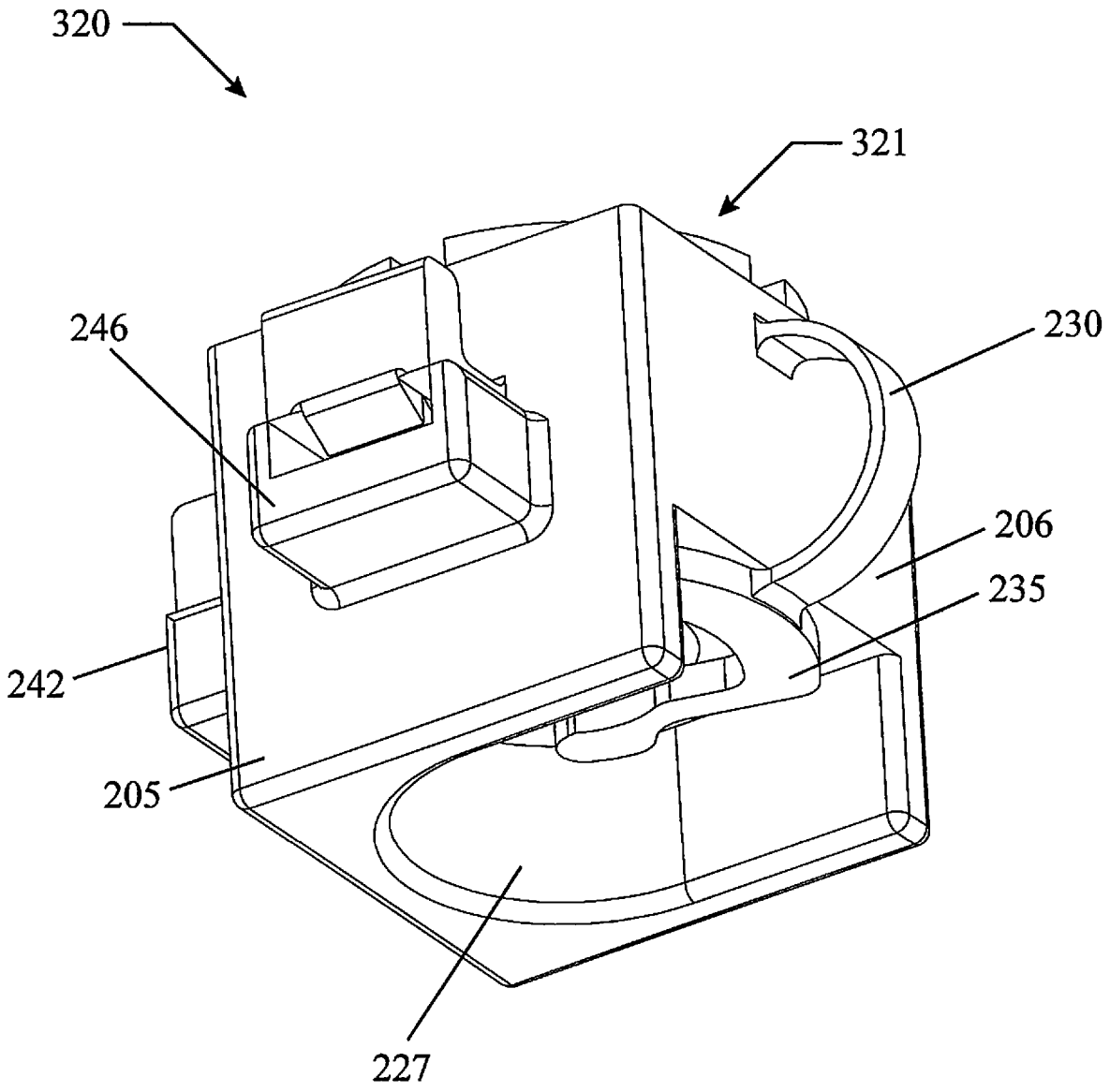

FIG. 23 is a lower right rear perspective view of the female fastener of FIG. 20.

Figure 24:
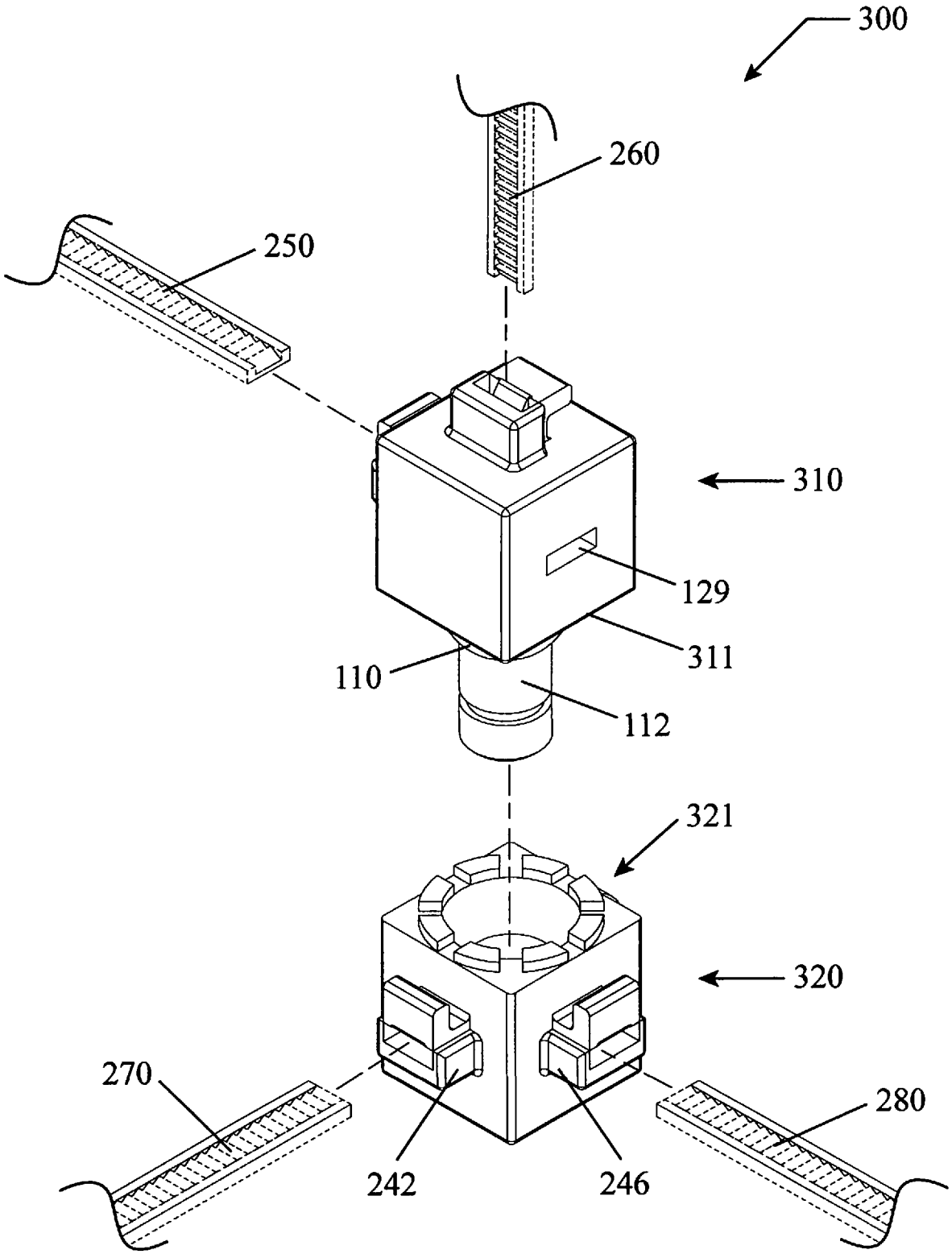

FIG. 24 is an exploded perspective view of the FIG. 18 male fastener to be attached to the FIG. 20 female fastener and straps about to be fastened to the male/female fasteners.

Figure 25:
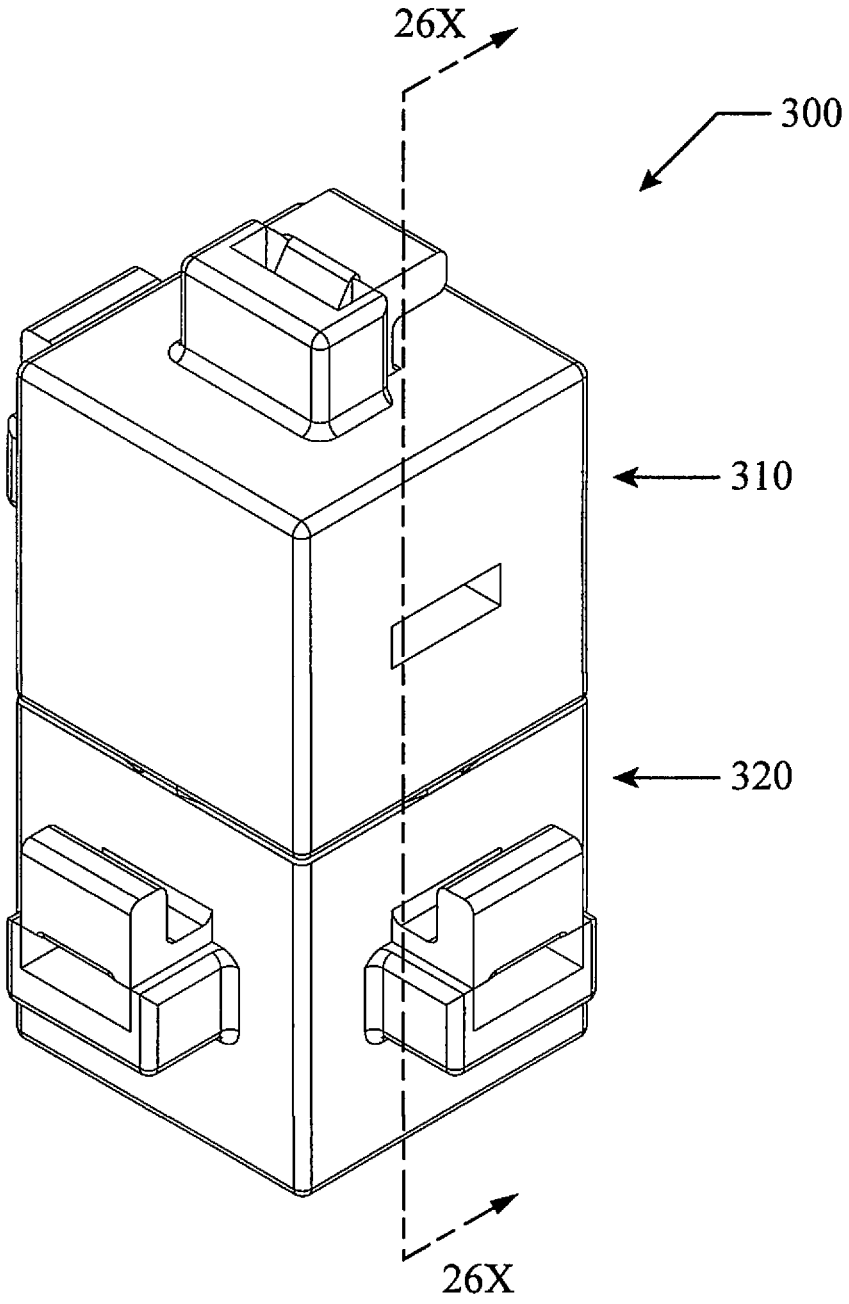

FIG. 25 is a perspective view of the male fastener and female fastener of FIG. 24 attached together.

Figure 26:
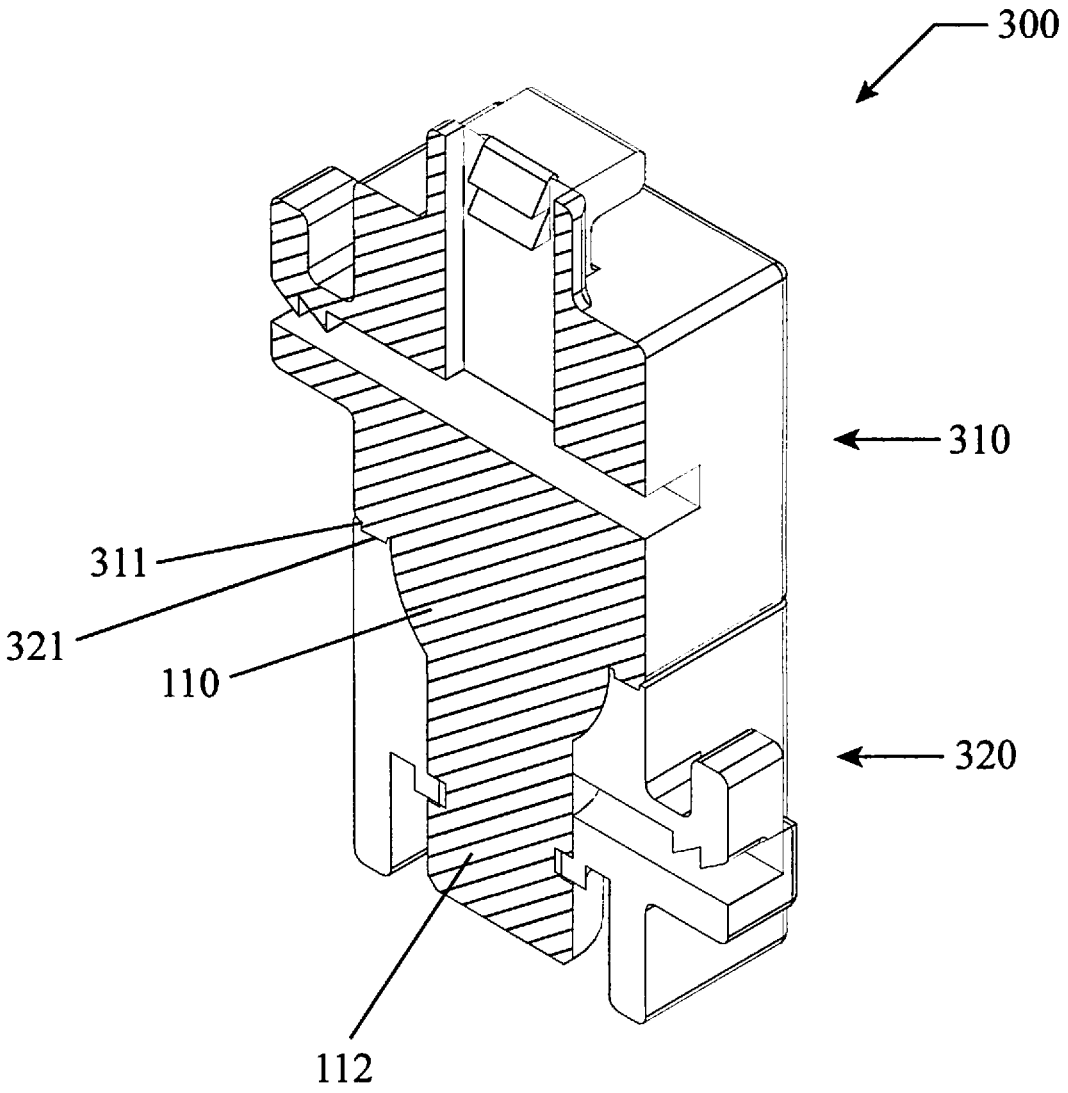

FIG. 26 is a cross-sectional perspective view of the attached male and female attached fasteners of FIG. 25 along arrows 26X.

Figure 27:
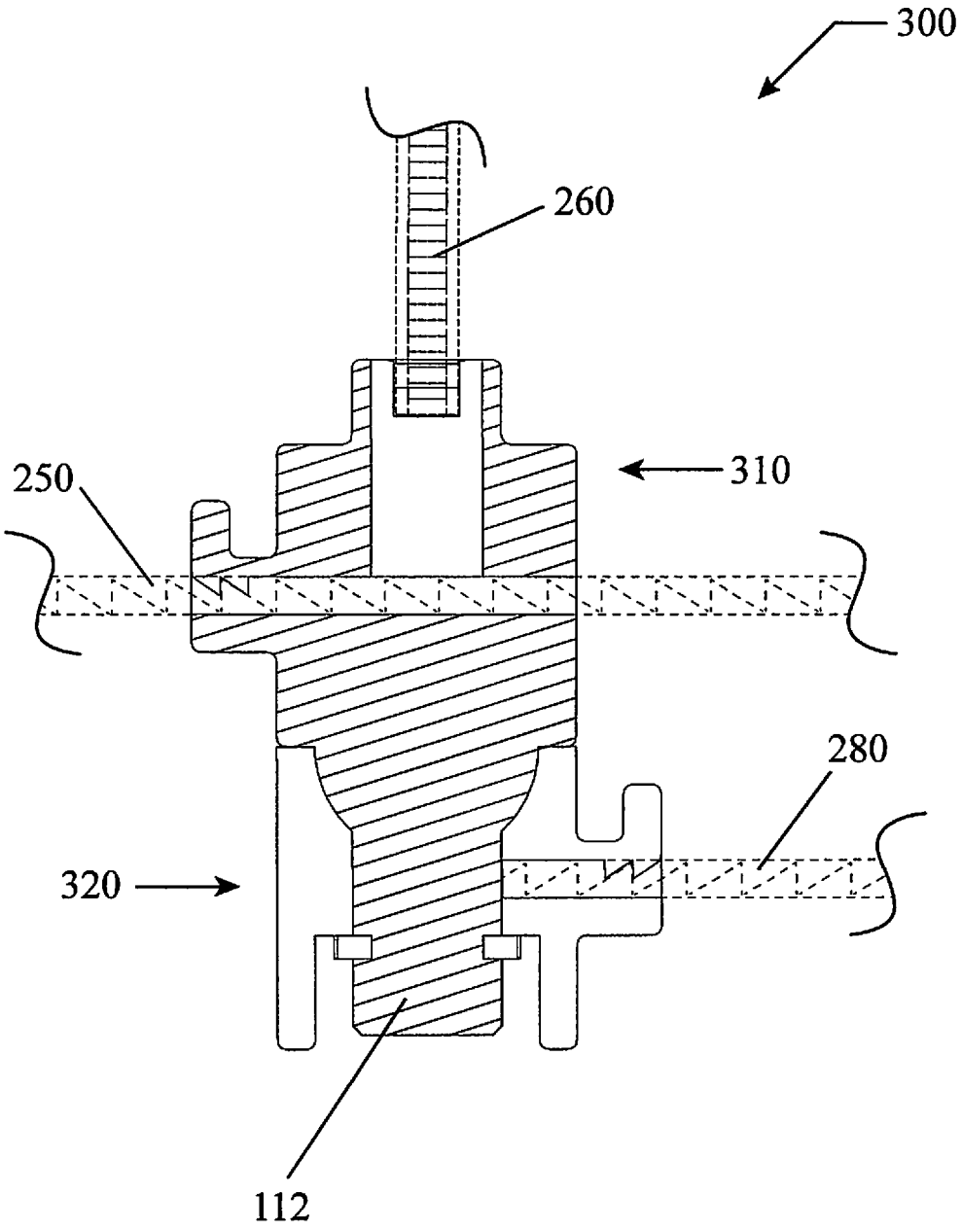

FIG. 27 is another view of the attached male and female fasteners of FIG. 26 with straps shown in FIG. 24 fastened.

Figure 28:
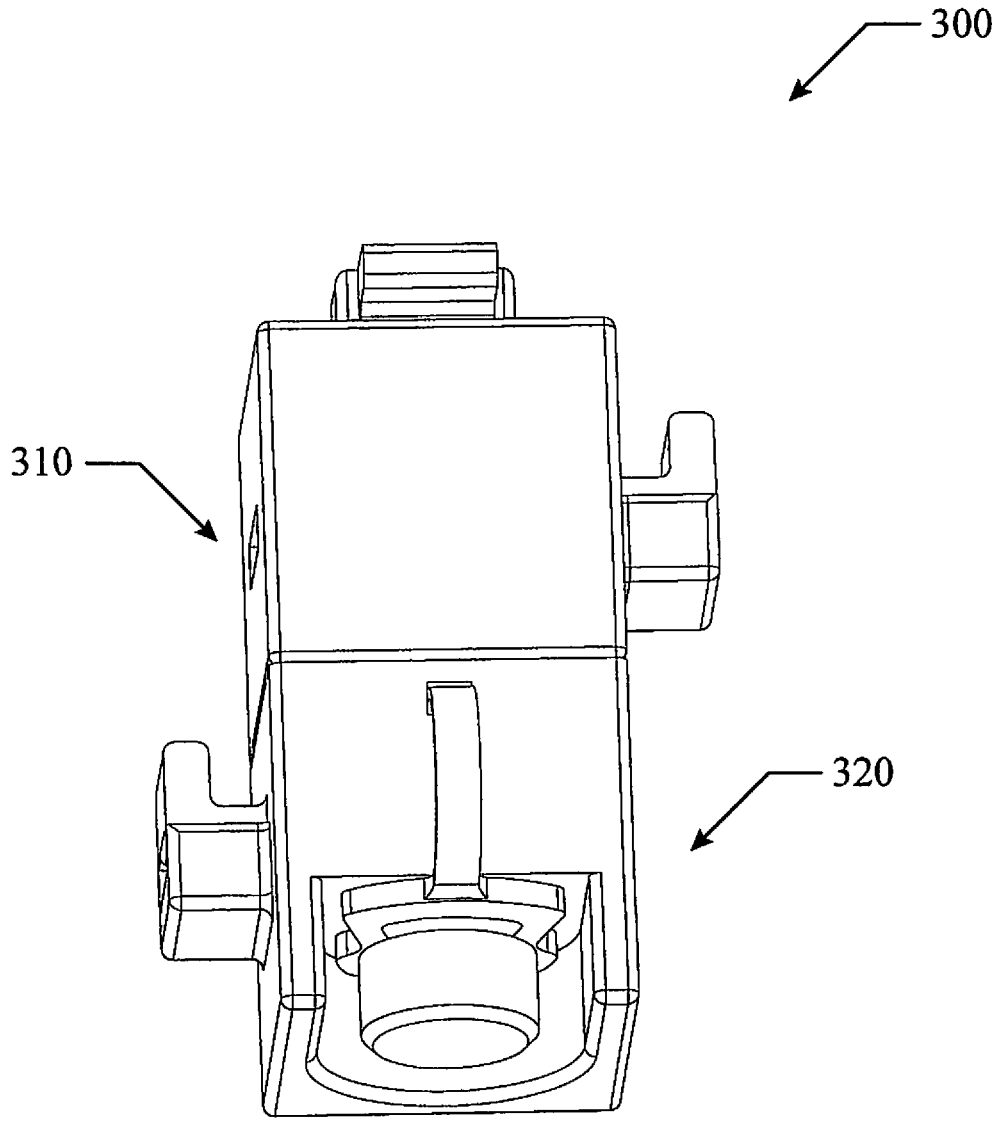

FIG. 28 is another perspective view of an opposite side of the attached male and female fasteners of FIG. 25.

Figure 29:
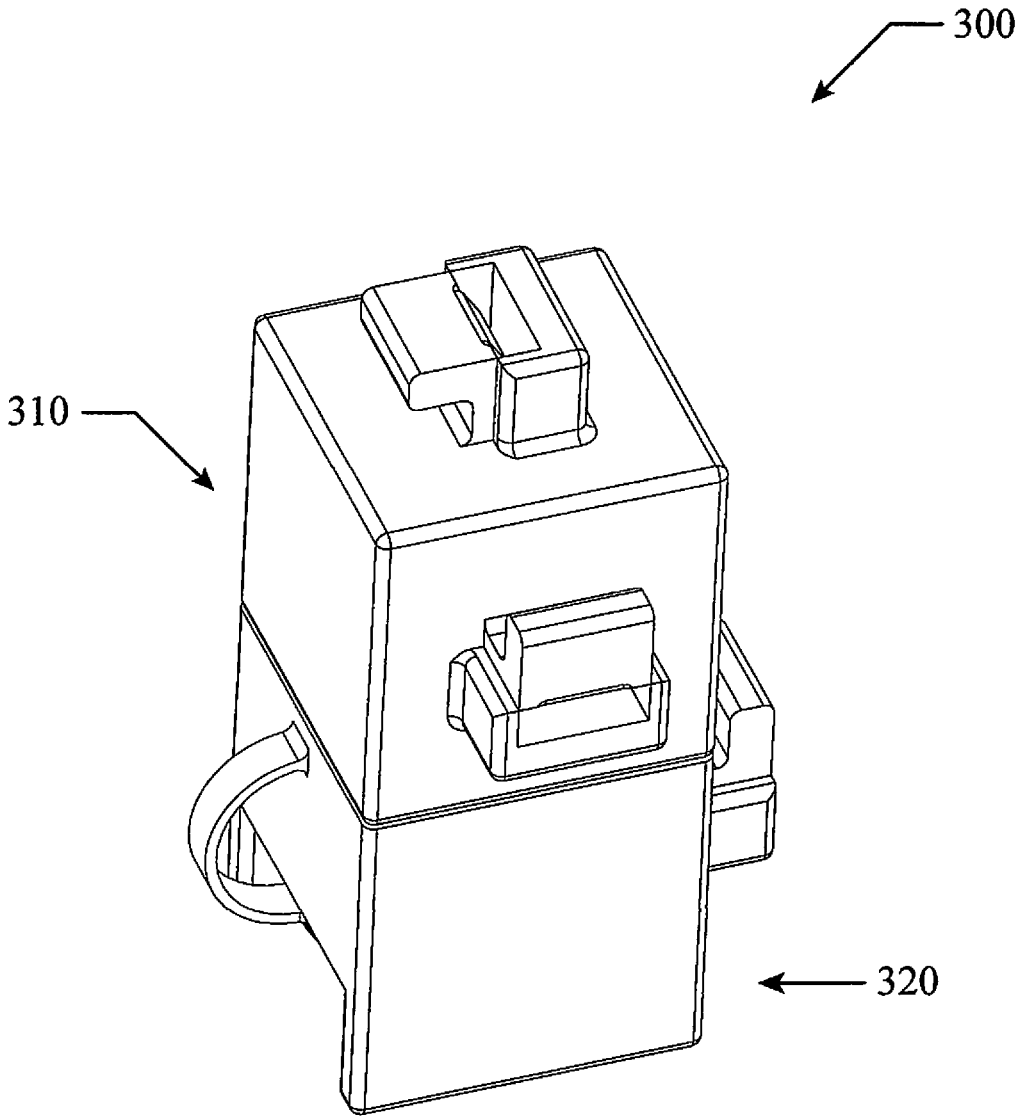

FIG. 29 is a right side perspective view of the attached male and female fasteners of FIG. 28.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

U.S. Pat. No. 9,637,291 to Montejo, which is incorporated by reference in its' entirety, is by the same inventor as the subject invention, and shows and describes a multi-positional closure fastener having two receivers that are fastened to one another by a pin so that zip tie straps can have their ends fastened together in receivers that pivot with one another.

However, the receivers are permanently attached to one another, and each receiver can only receive one end of a zip tie strap.

A list of components will now be described.

1 First Embodiment Rotatable Multipositional Fastening System

100 Male Fastener, first receiver housing (with male member/part)

110 box shape

102 top wall

104 first sidewall

Figure 1:
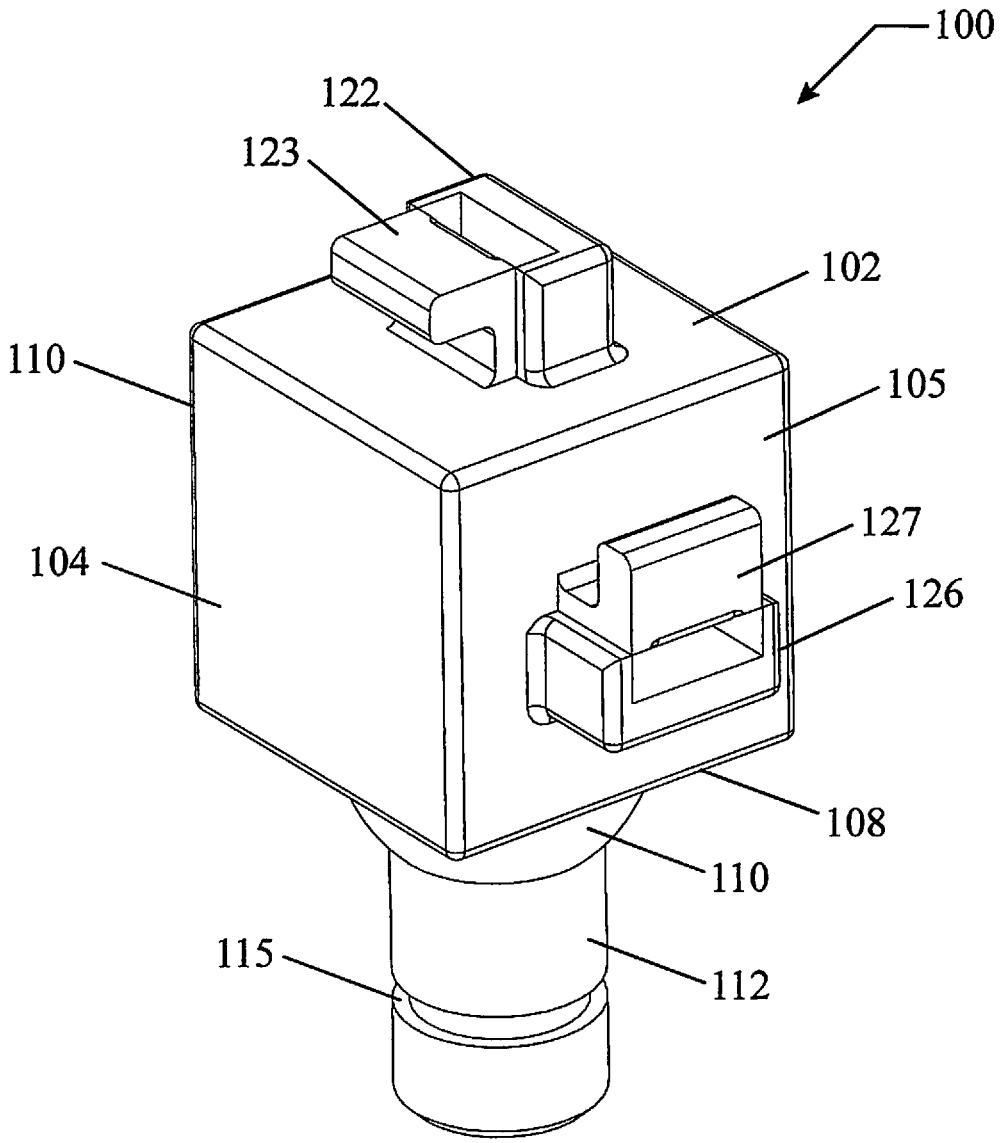
FIG. 1 is an upper front right perspective view of a male fastener of the rotatable multipositional fastener system.
Figure 2:
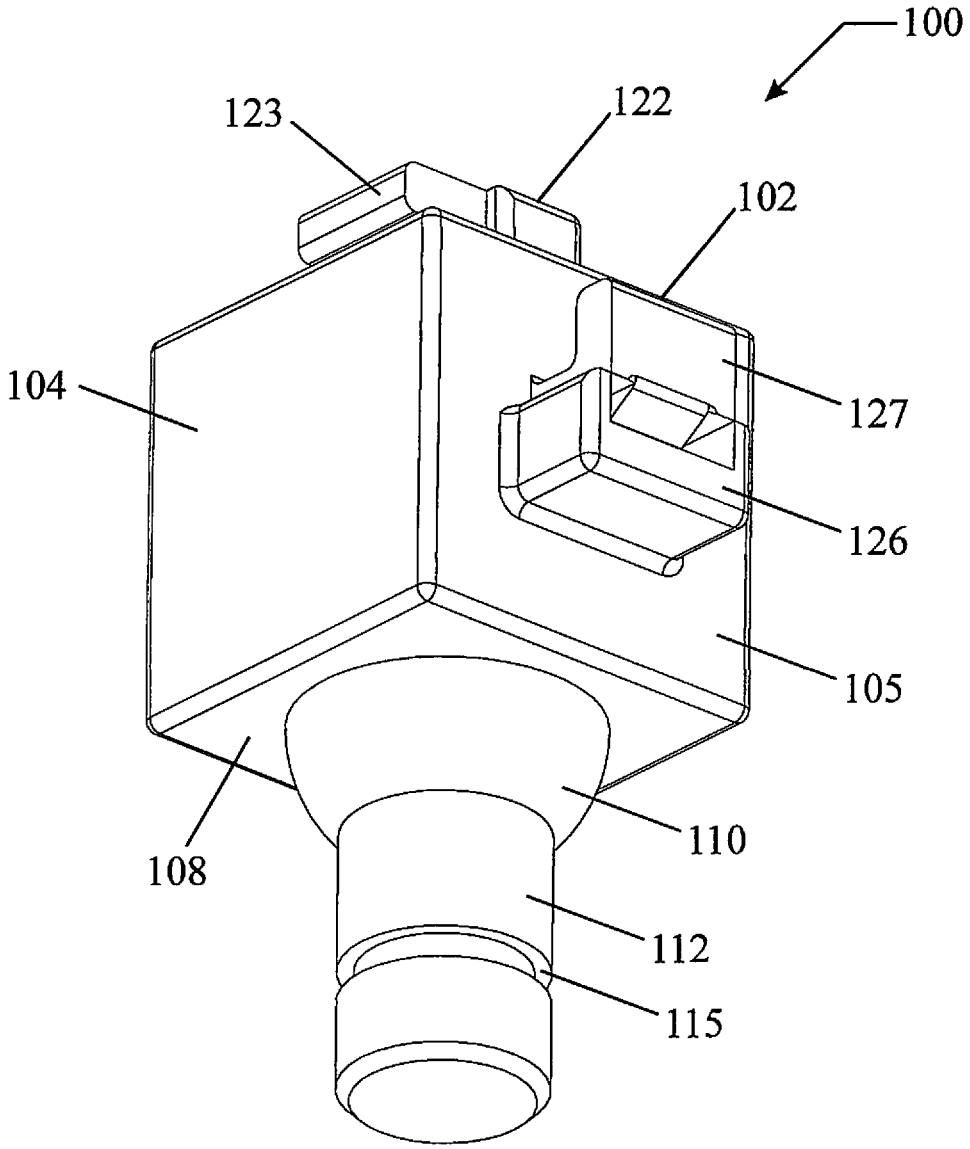
FIG. 2 is a lower front right perspective view of the male fastener of FIG. 1.
Figure 3:
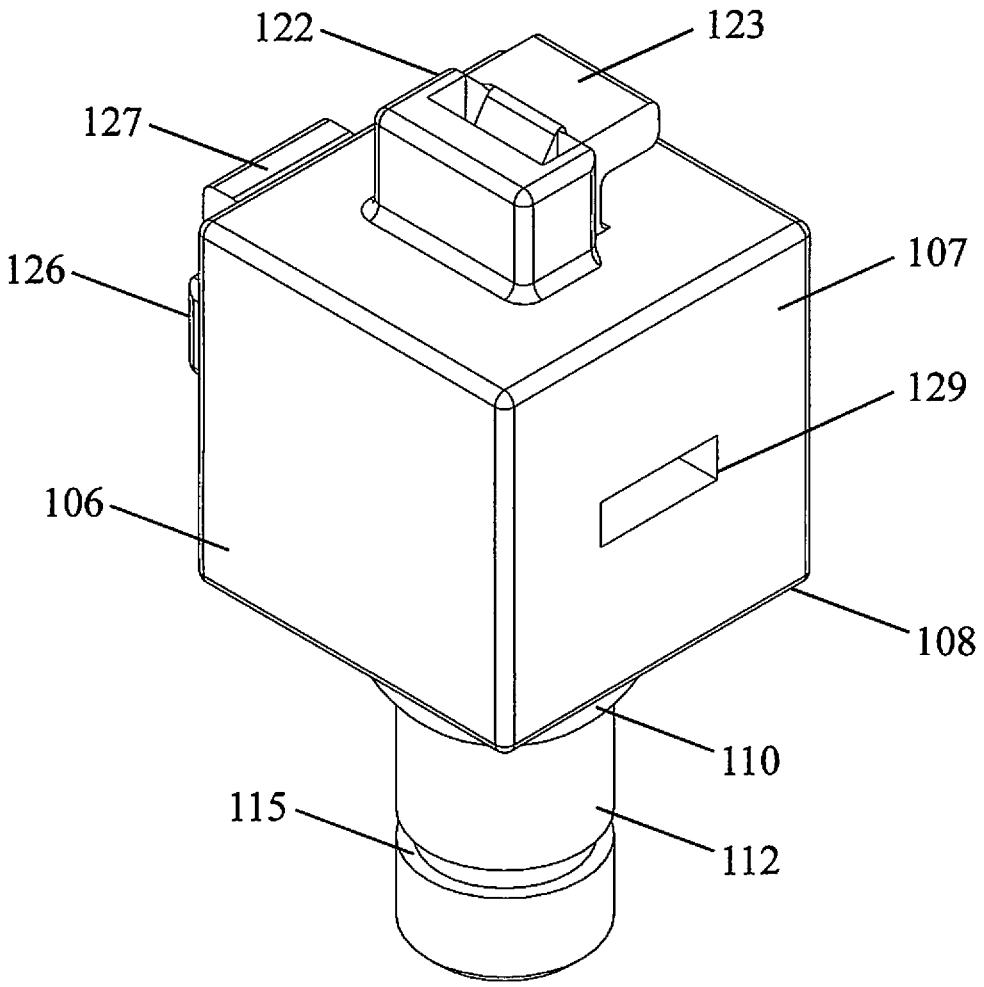
FIG. 3 is an upper rear right perspective view of the male fastener of FIG. 1.
Figure 4:
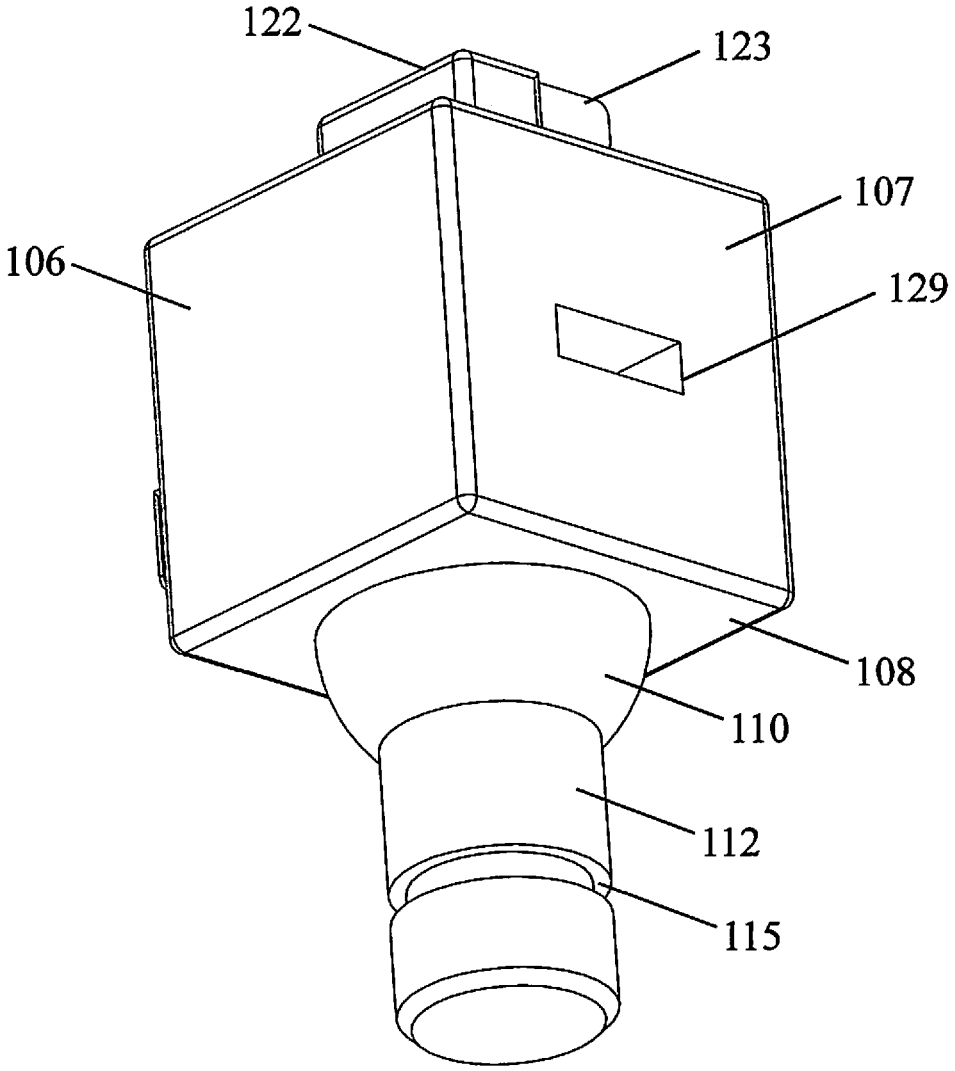
FIG. 4 is a lower rear right perspective view of the male fastener of FIG. 1.

105 second sidewall
106 third sidewall
107 fourth sidewall
108 bottom wall
110 semi-hemispherical base
112 cylindrical stem
115 groove about stem
122 top opening
123 latch member
124 catch
126 one side opening
127 latch member
128 catch
129 second side opening with no latch member
200 Female Fastener, Second receiver housing (with female slot)
202 top wall
204 first sidewall
205 second sidewall
206 third sidewall
207 fourth sidewall
208 bottom wall
210 Box shape
220 bowl shape indentation
225 through hole
227 U shaped opening
230 arm
235 clamp end
242 first side opening
243 first latch member
244 first catch
246 second side opening
247 second latch member
248 second catch
250 first strap
260 second strap
270 third strap
280 fourth strap
300 Second Embodiment Rotatable Multipositional Fastening System with Male Fastener and Female Fastener Locking Members
310 Male Fastener
311 Locking Member Ring
312 Protrusions
316 Valleys between protrusions
320 Female Fastener
321 Locking Member Ring
322 Protrusions
326 Valleys between protrusions First Embodiment FIG. 1 is an upper front right perspective view of a male fastener 100 of the rotatable multipositional fastener system 1. FIG. 2 is a lower front right perspective view of the male fastener 100 of FIG. 1. FIG. 3 is an upper rear right perspective view of the male fastener 100 of FIG. 1. FIG. 4 is a lower rear right perspective view of the male fastener 100 of FIG. 1.

Referring to FIGS. 1-4, the rotatable multipositional fastener system 1 (shown in FIG. 9) can include a first receiver housing (male receiver) 100 that can be a single plastic molded part, that can have a generally box shape 110. The first receiver housing 110 can include a top wall 102, four sidewalls 104, 105, 106 and 107, and a bottom wall 108. Extending downward from the bottom wall 108 can be a semi-hemispherical shaped base 110, with a generally cylindrical stem portion 112 extending therefrom with a ring shaped groove 115 about a mid-portion of the stem portion 112.

Figure 5:
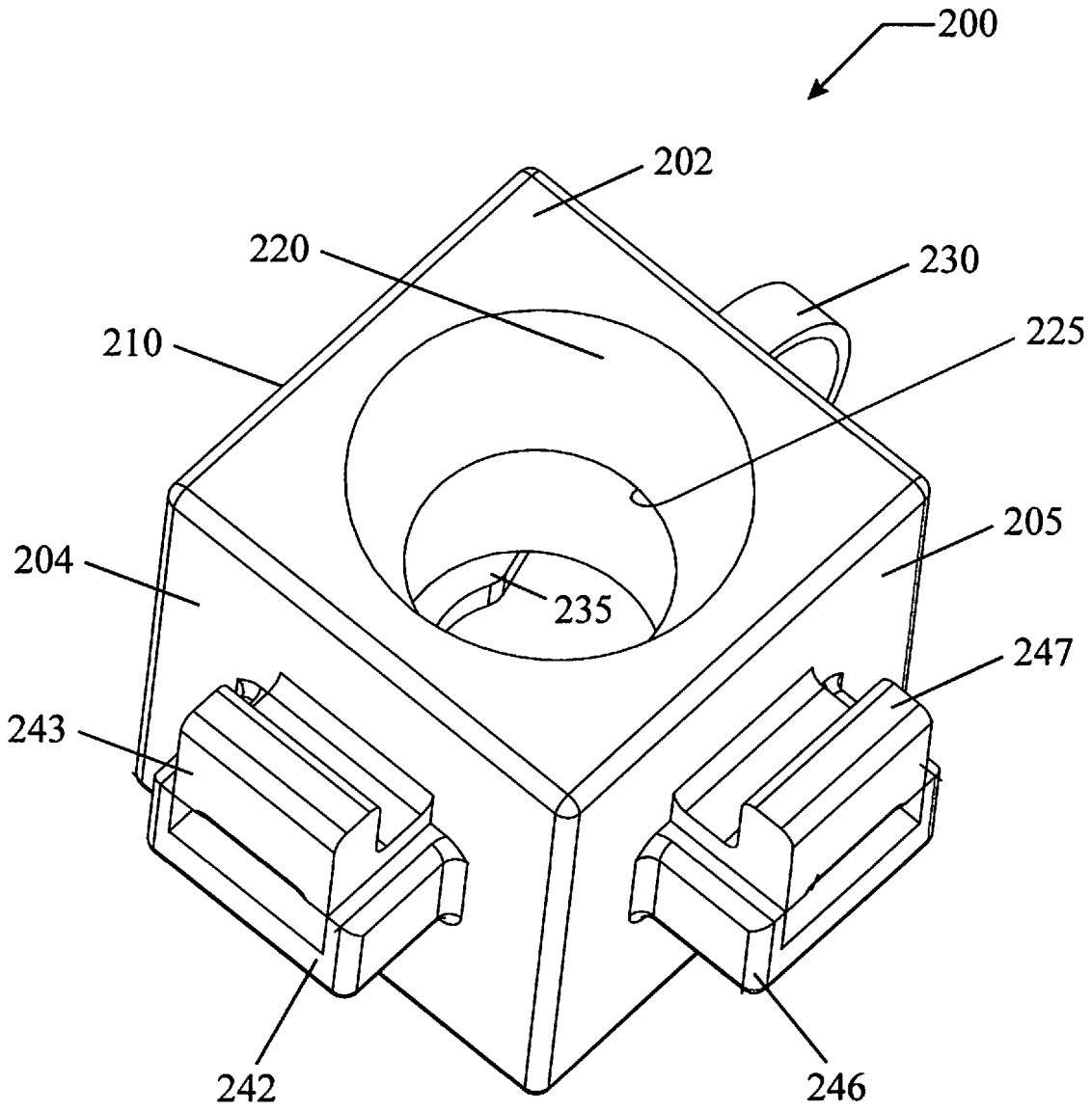
FIG. 5 is an upper front right perspective view of the female fastener of the rotatable multipositional fastener system used with the male fastener of FIG. 1.
Figure 6:
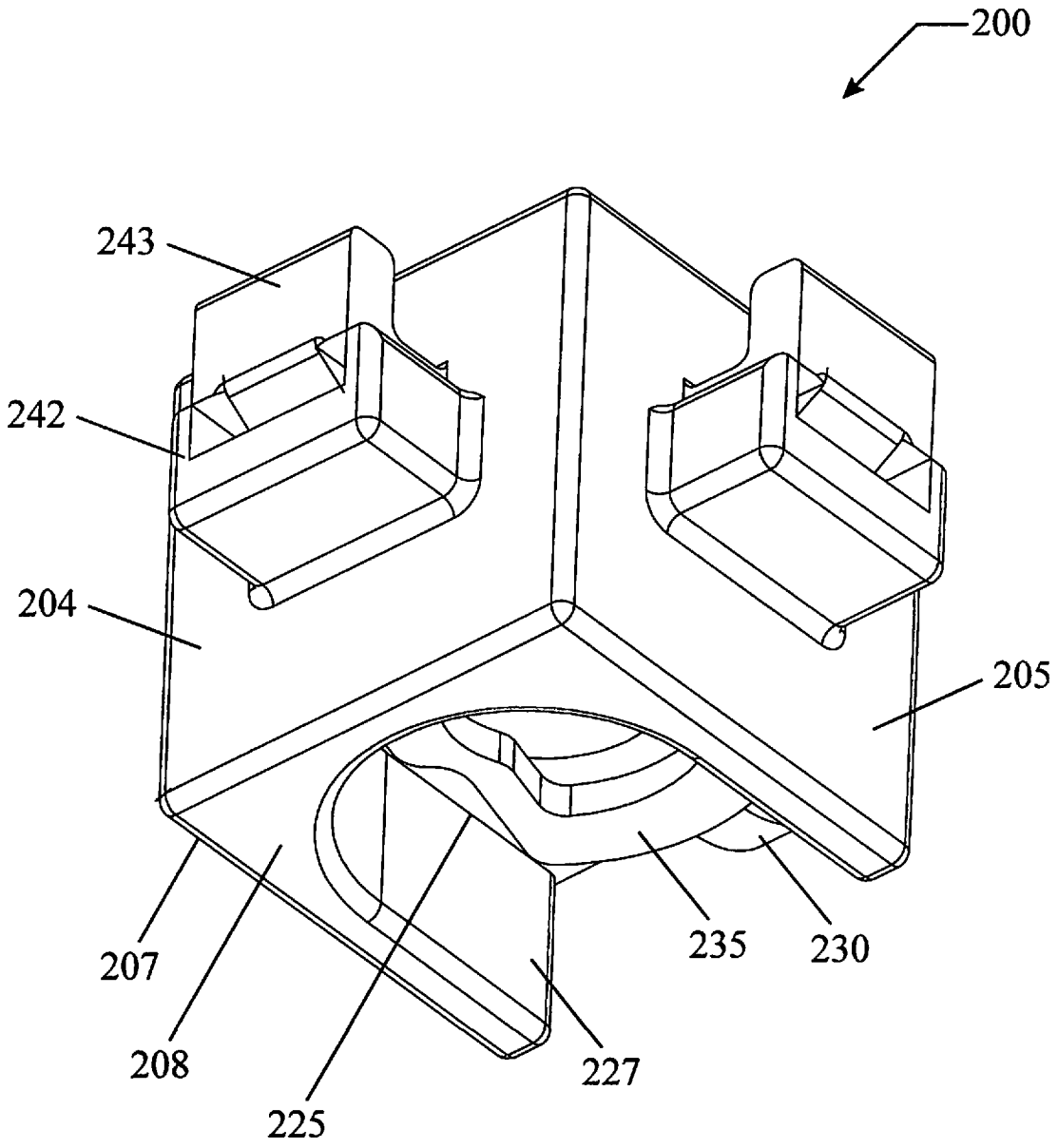
FIG. 6 is a lower front right perspective view of the female fastener of FIG. 5.
Figure 7:
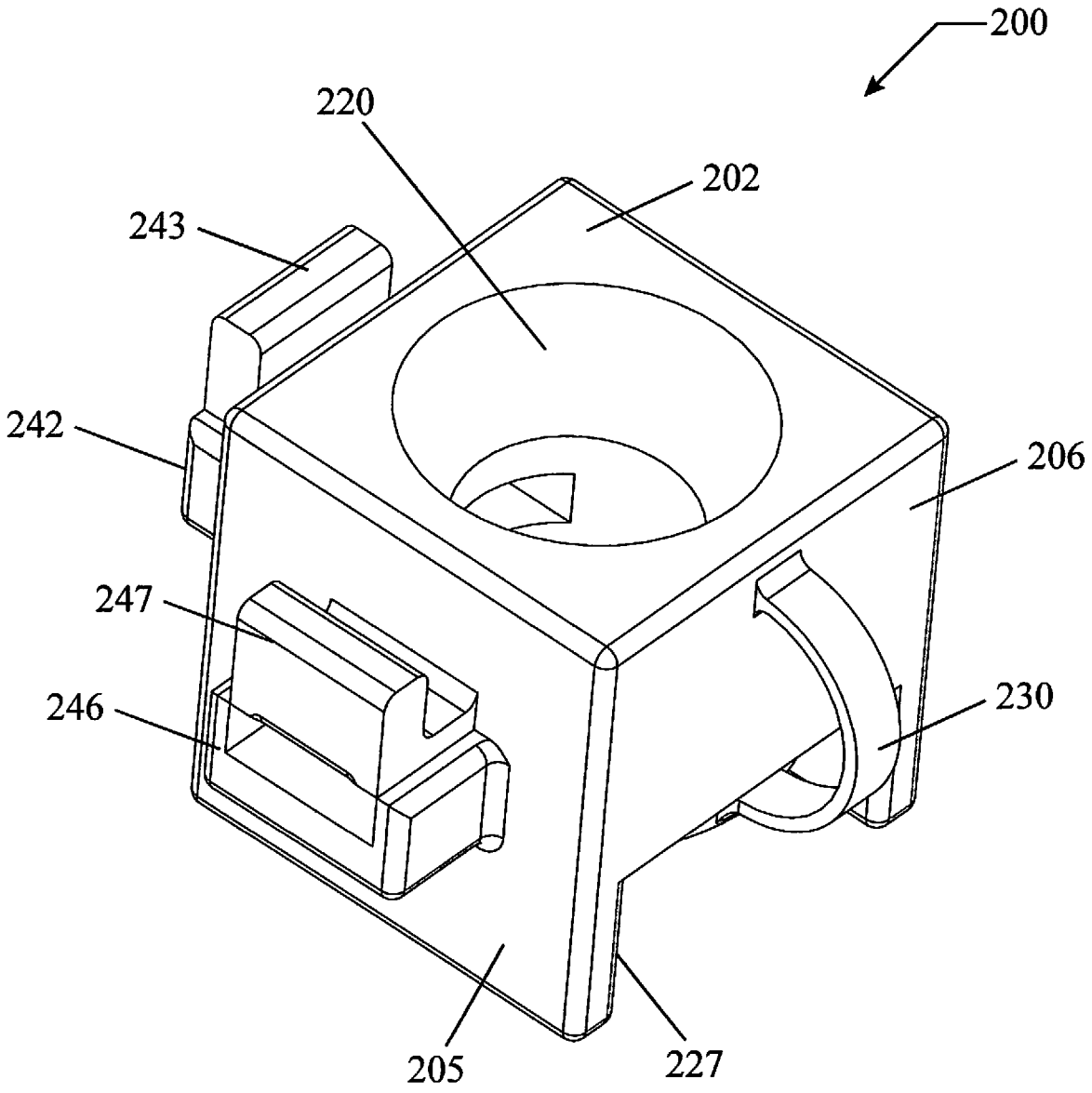
FIG. 7 is an upper right rear perspective view of the female fastener of FIG. 5.
Figure 8:
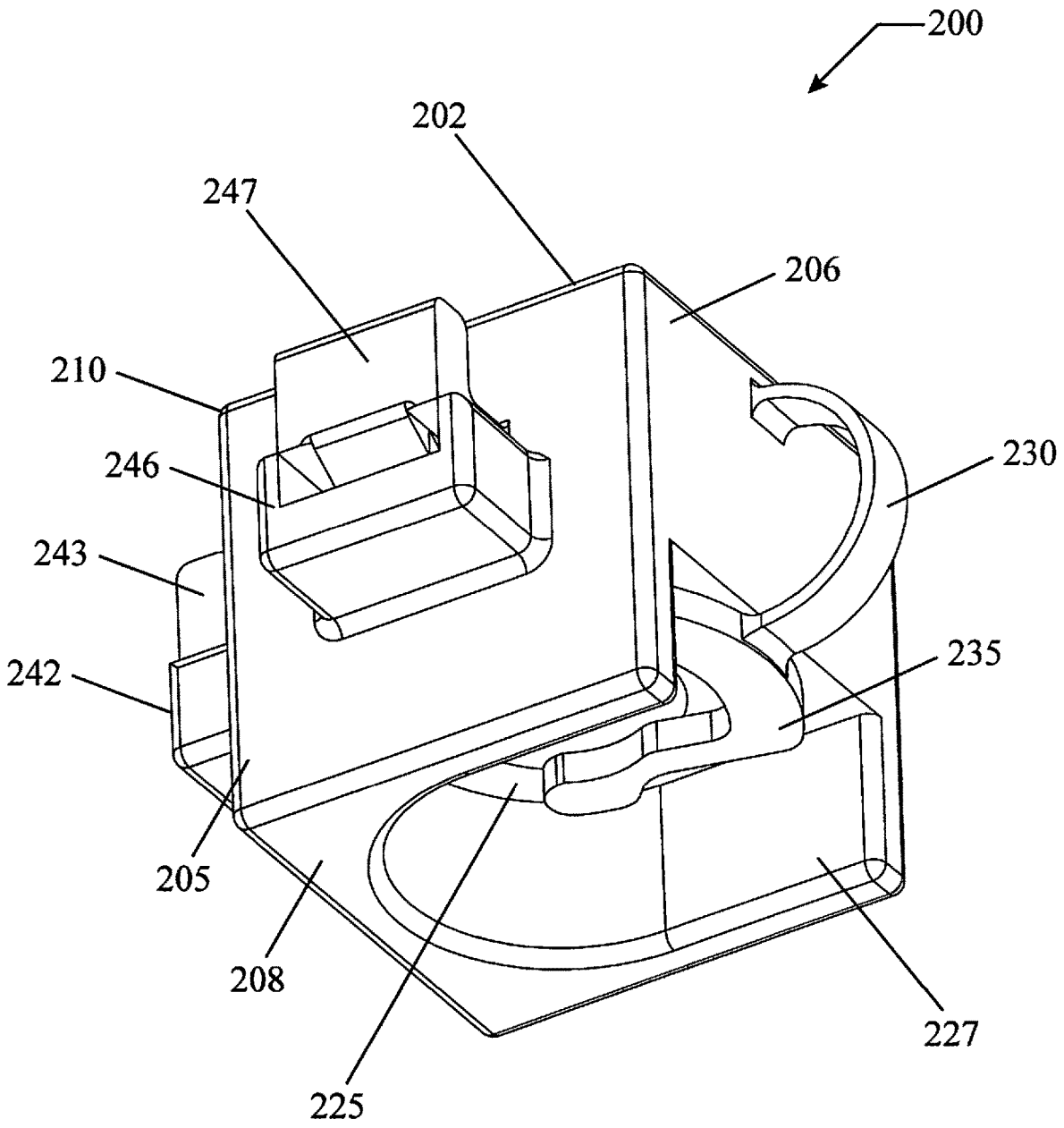
FIG. 8 is a lower right rear perspective view of the female fastener of FIG. 5.

FIG. 5 is an upper front right perspective view of the female fastener 200 of the rotatable multipositional fastener system 1 used with the male fastener 100 of FIG. 1. FIG. 6 is a lower front right perspective view of the female fastener 200 of FIG. 5. FIG. 7 is an upper right rear perspective view of the female fastener 200 of FIG. 5. FIG. 8 is a lower right rear perspective view of the female fastener 200 of FIG. 5.

Referring to FIGS. 5-8, the rotatable multipositional fastener system 1 (shown in FIG. 9) can include a second receiver housing 200 which can be a female fastener, that can be a single plastic molded part, that can have a generally box shape 210 with a top 202, first sidewall 204, second sidewall 205, third sidewall 206, fourth sidewall 207 and a bottom wall 208.

In the top wall 202 can be bowl shape indentation 220 with a through-hole 225 through the receiver housing 200.

On the first sidewall 204 can be a side opening 242 with a latch member 243. The second sidewall 205 can include a side opening 246 with a second latch member 247.

Extending from the third sidewall 206 can be an arm 230 having a clamp end 235. While not being used, the arm 230 can have a memory that allows the clamp end 235 to angled into the side U shaped opening 227 in the lower sidewall 206 of the housing 200.

Figure 9:
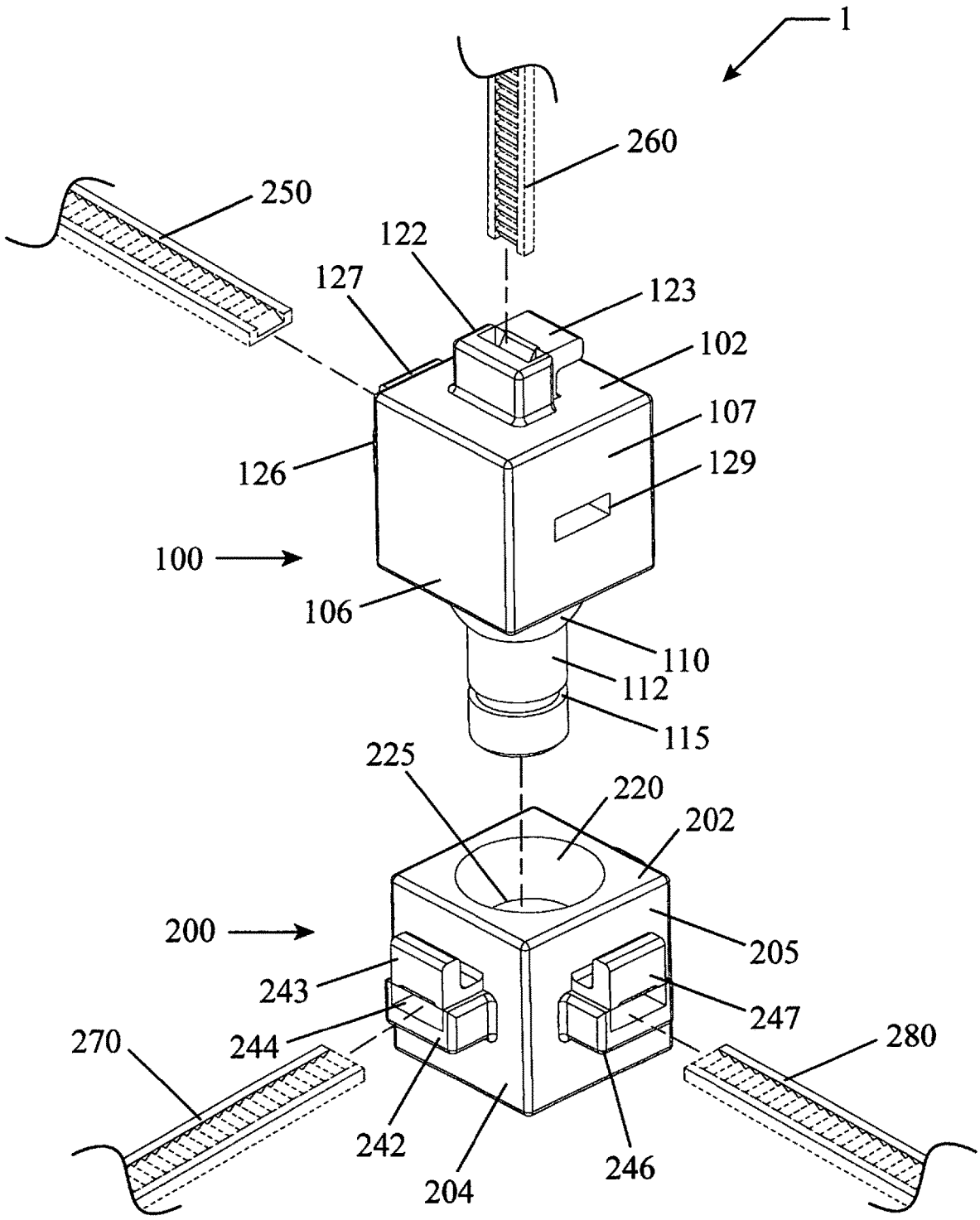
FIG. 9 is an exploded perspective view of the FIG. 3 male fastener to be attached to the FIG. 5 female fastener and straps about to be fastened to the male/female fasteners.

FIG. 9 is an exploded perspective view of the FIG. 3 male fastener (first receiver) 100 to be attached to the FIG. 5 female fastener (second receiver) 200 and straps 250, 260, 270, 280 about to be fastened to the male fastener (first receiver) 100 and female fastener (second receiver) 200. The straps 250, 260, 270 and 280 can be elongated straps having parallel ridges with indented spaces between each ridge. A ridge can have a right triangular configuration, and the like. So that the catches in the side and top openings of the receiver housings 100, 200 can lock into the spaces between the raised ridges.

Figure 10:
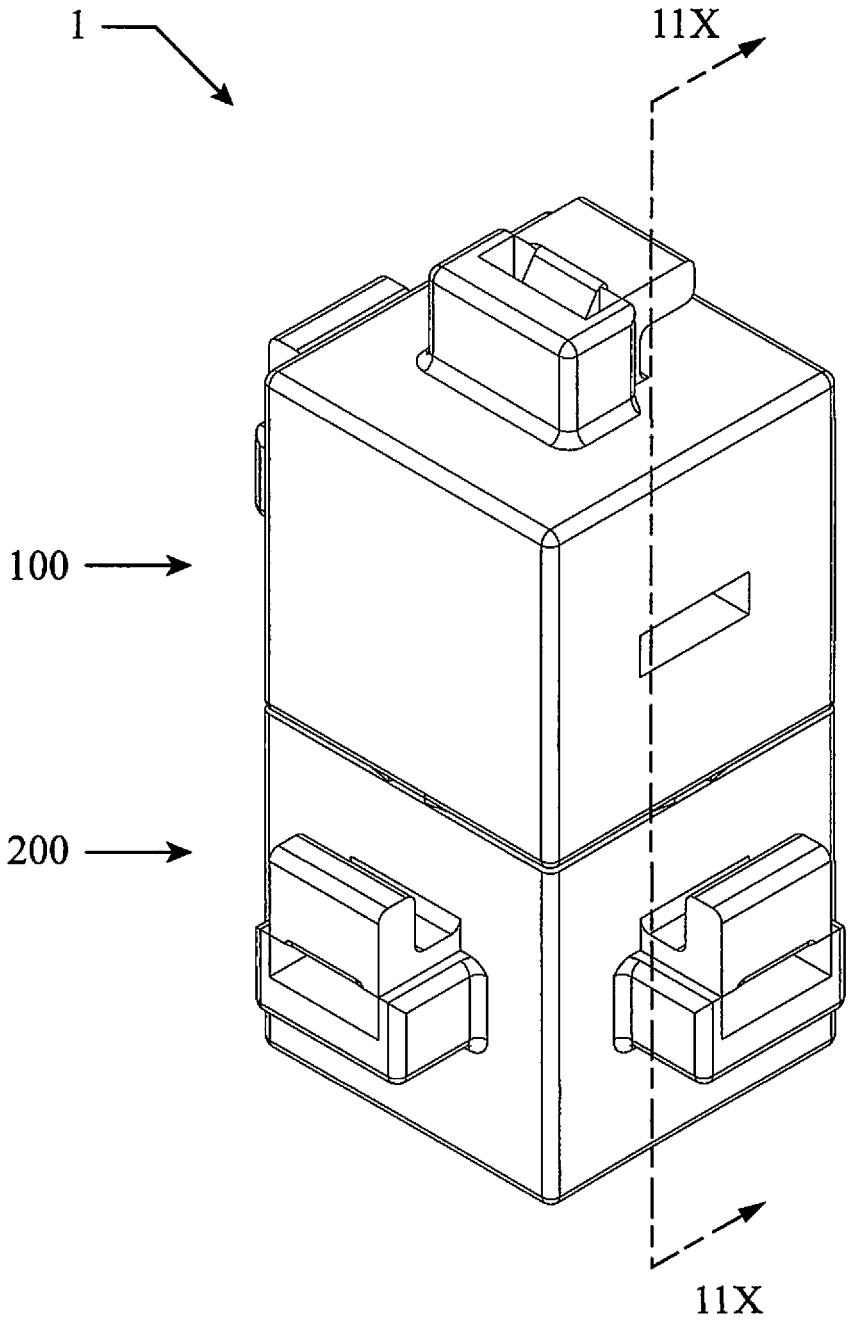
FIG. 10 is a perspective view of the male fastener and female fastener of FIG. 9 attached together.
Figure 11:
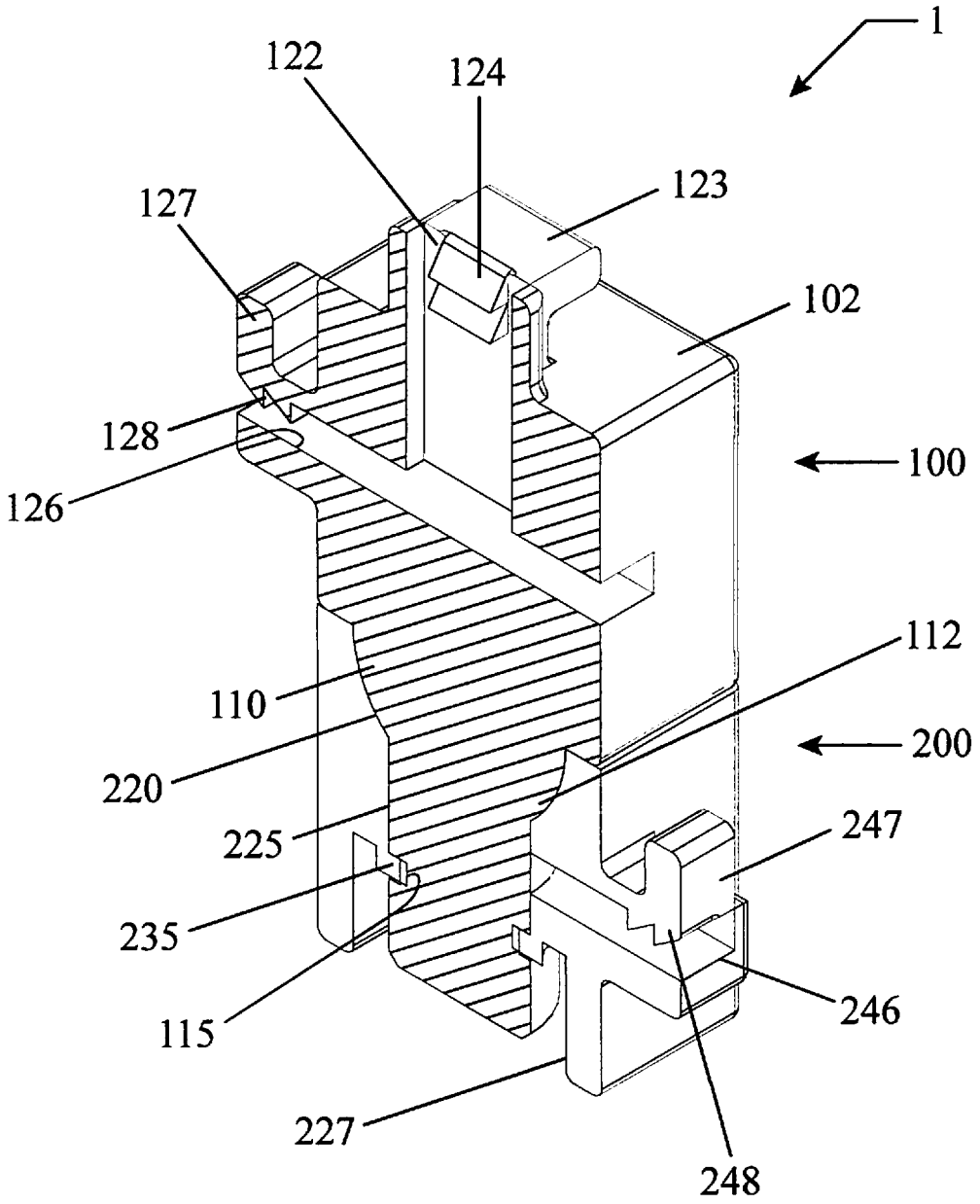
FIG. 11 is a cross-sectional perspective view of the attached male and female attached fasteners of FIG. 10 along arrows 11X.
Figure 12:
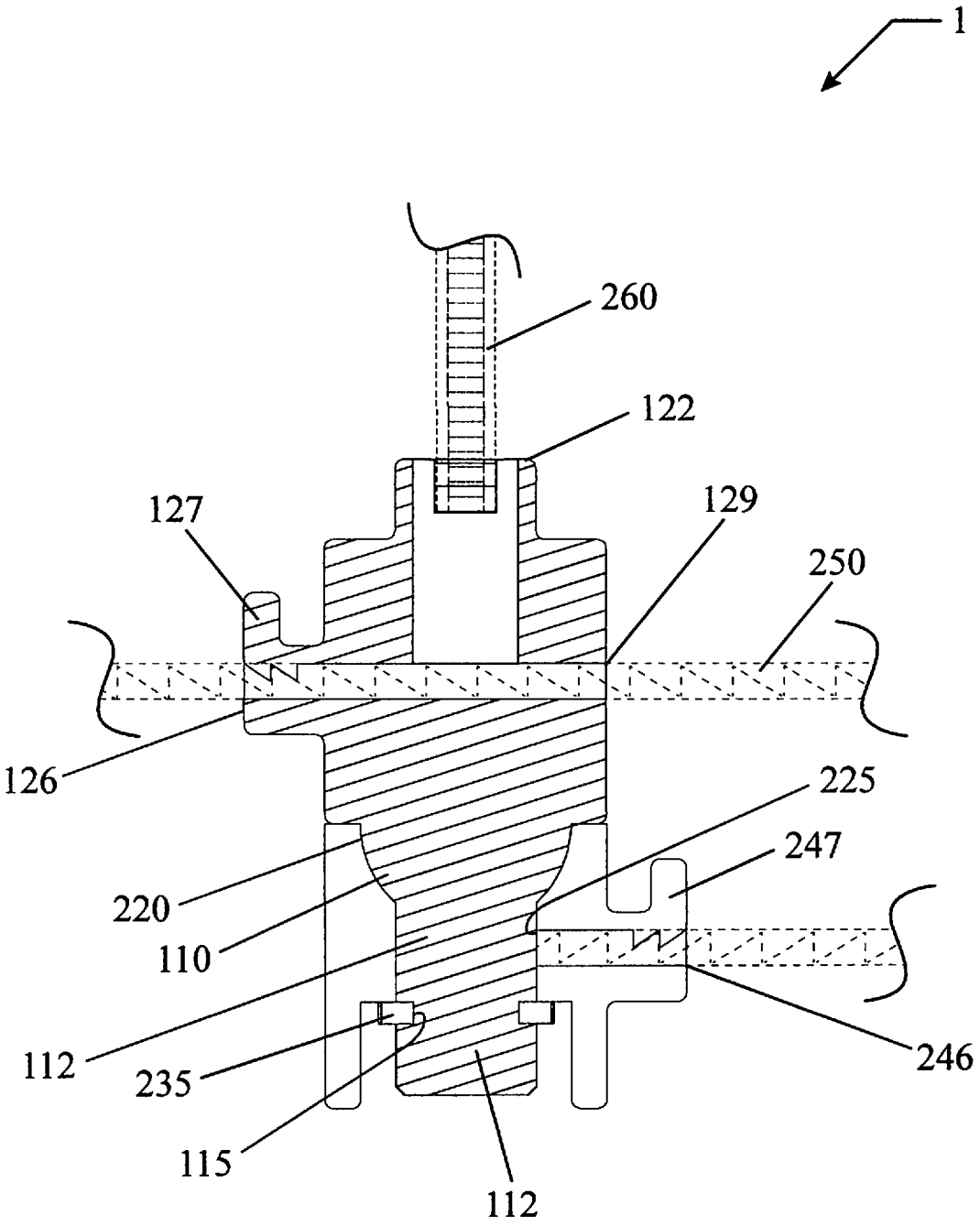
FIG. 12 is another view of the attached male and female fasteners of FIG. 11 with straps shown in FIG. 9 fastened.

FIG. 10 is a perspective view of the male fastener (first receiver) 100 and female fastener (second receiver) 200 of FIG. 9 attached together. FIG. 11 is a cross-sectional perspective view of the male fastener (first receiver) 100 attached to the female fastener (second receiver) 200 of FIG. 10 along arrows 11X. FIG. 12 is another view of the attached male and female fasteners 100, 200 of FIG. 11 with straps 250, 260, 270, 280 shown in FIG. 9 fastened.

Figure 13:
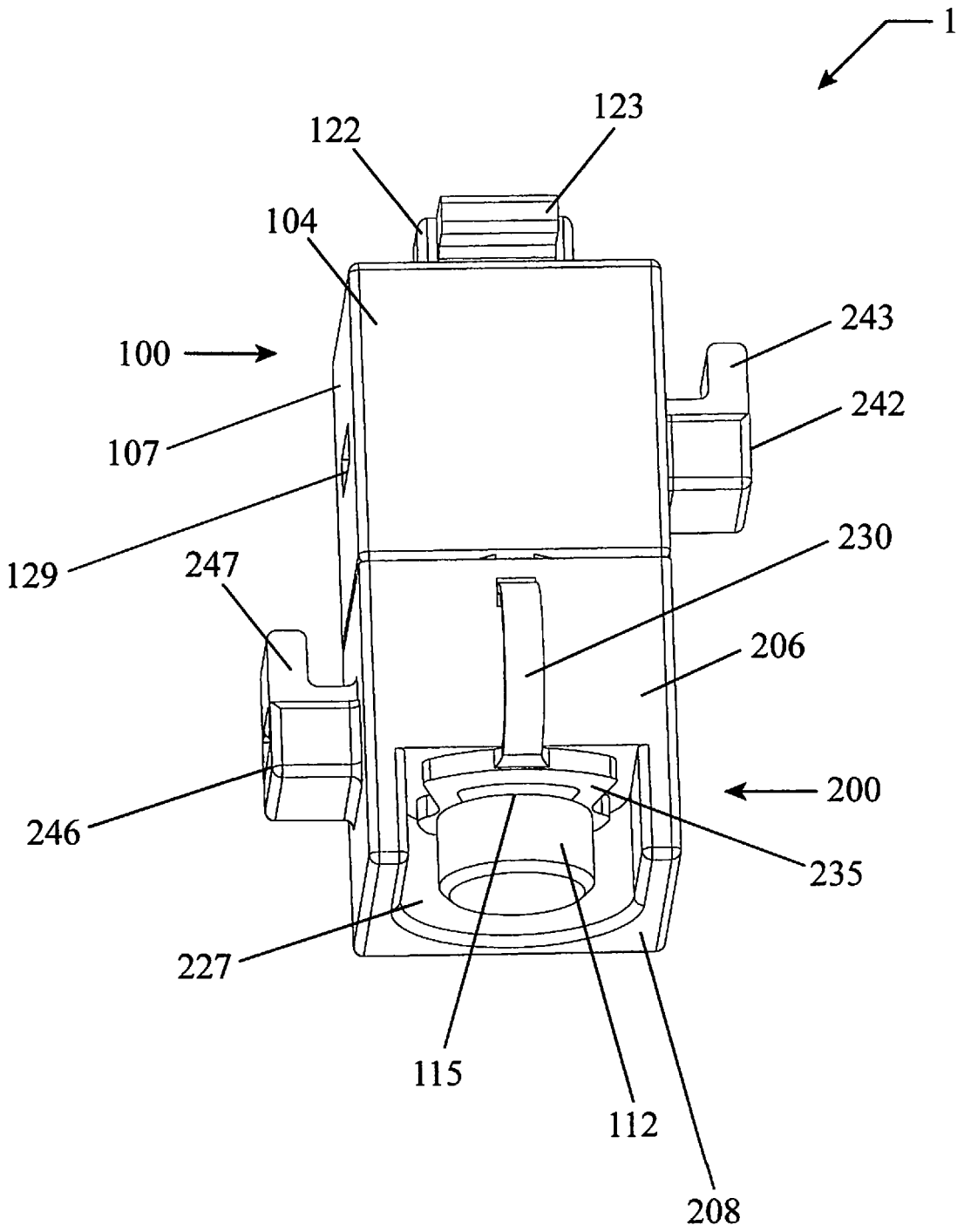
FIG. 13 is another perspective view of an opposite side of the attached male and female fasteners of FIG. 10.
Figure 14:
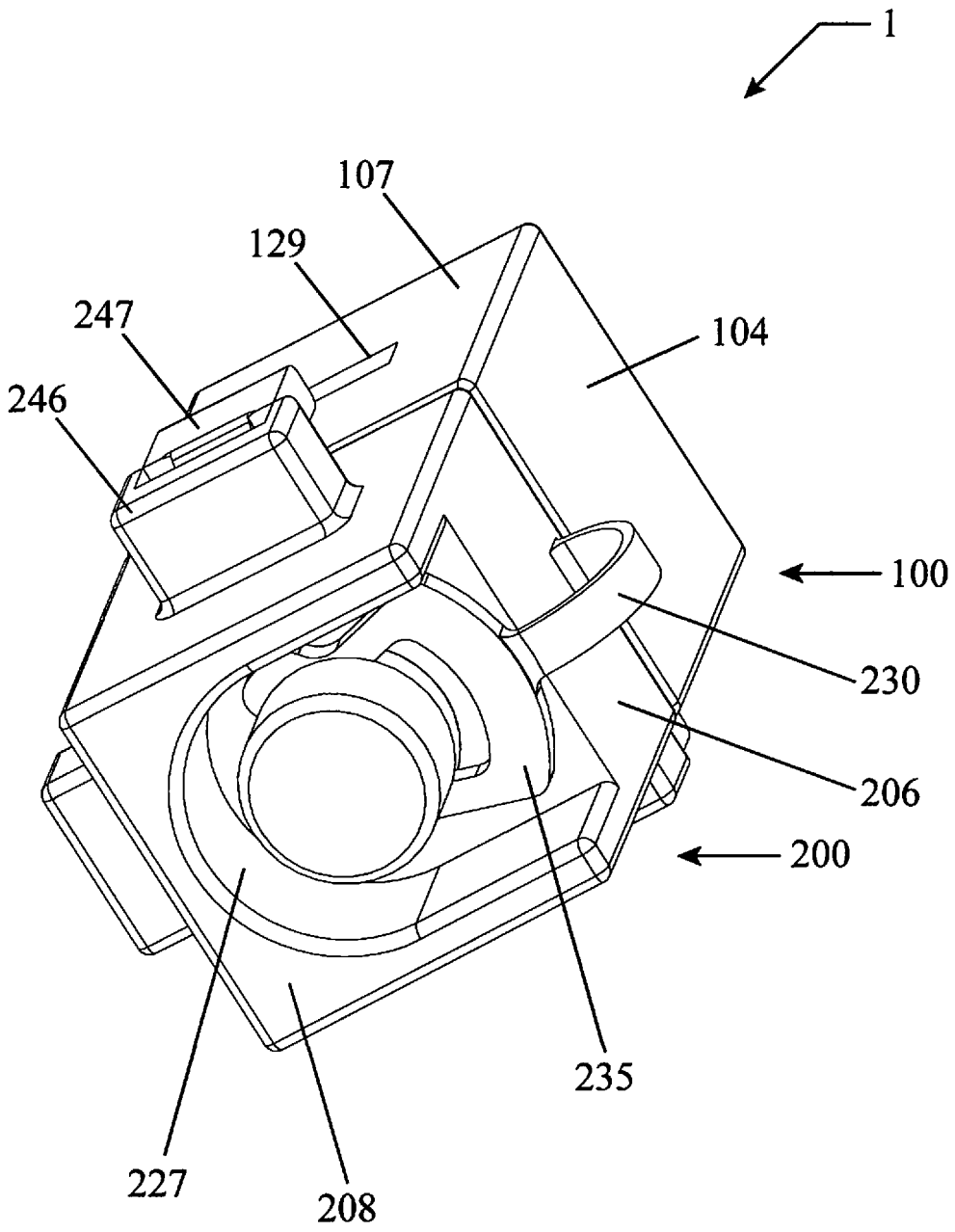
FIG. 14 is a lower left perspective view of the attached male and female fasteners of FIG. 13.

FIG. 13 is another perspective view of an opposite side of the male fastener (first receiver) 100 attached to the female fastener (second receiver) 200 of FIG. 10. FIG. 14 is a lower left perspective view of the attached male and female fasteners 100, 200 of FIG. 13.

Figure 15:
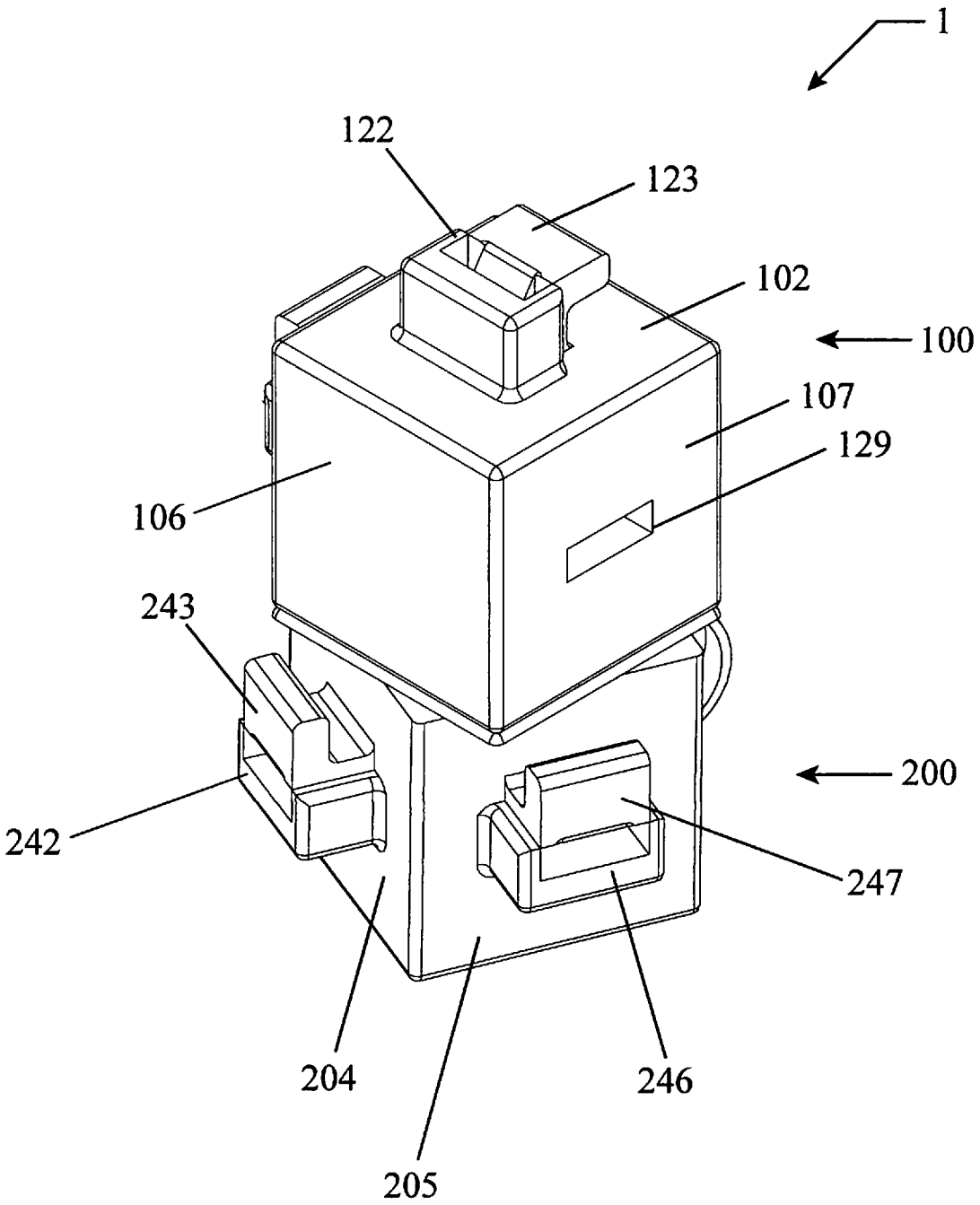
FIG. 15 is another perspective view of the attached male and female fasteners of FIG. 10 with male fastener rotated partially counter-clockwise relative of the female fastener.

FIG. 15 is another perspective view of the attached male and female fasteners 100, 200 of FIG. 10 with male fastener 100 rotated partially counter-clockwise relative of the female fastener 200.

Referring to FIGS. 9-15, the male stem 112 of the male fastener 100 is positioned into the through-hole opening 225 into the top wall 202 of the female receiver 200 until the semi-hemispherical base 110 extending from the bottom wall 108 of the male fastener 100 rests adjacent to the bowl shaped indentation in the top wall 201 of the female fastener 200. The generally U-shaped clamp end 235 of the arm 230 extends from the sidewall 206 are all molded as part of the female fastener 200. The C shaped clamp 235 can be pushed about the circular groove 115 on the stem 112 which locks the male fastener 100 to the female fastener 200. The C shaped clamp end 235 can be rigid enough to wrap into the circular groove 115 so that the male fastener 100 stays attached to the female fastener 200. However, the C shaped clamp end 235 can be loose enough so that the male fastener 100 and female fastener 200 are still able to rotate clockwise or counter-clockwise relative to one another.

Referring to FIGS. 9-12, one end of a strap 250 can be inserted through an opening 126 of receiver housing 100 and pass out of the opposite side opening 129. A catch 128 having downwardly protruding triangle/wedge portions can lock into some of the parallel grooves on the strap 250 to lock it in place. To remove the strap 250, the user can push up the latch member 127 which lifts the catch 128 allowing the strap 250 to be pulled out of the receiver housing 100. An end of another strap 260 can be inserted into top opening 122 of the receiver housing 100 can similarly locked in place with catch 124. To remove strap 260, the user can push latch member 123 toward the receiver housing 100 which lifts the catch 124 from the grooves in the strap 260 allowing the strap 260 to be pulled out.

One end of strap 270 can be attached similarly in side opening 242 of receiver housing 200 also using a similar catch (not shown) and released with the latch member 244. An end of strap 280 can be similarly attached to opening 246 in the receiver housing 200 and locked in place with catch 248 and released by pushing in latch member 247.

Although the embodiments show some locations of side openings and top openings for locking straps thereto, the other locations of openings on any surface of the receiver housings can be used.

Second Embodiment

FIG. 16 is an upper front right perspective view of another male fastener 310 of another rotatable multipositional fastener system 300 shown in FIGS. 24-29. FIG. 17 is a lower front right perspective view of the male fastener 310 of FIG. 16. FIG. 18 is an upper rear right perspective view of the male fastener 310 of FIG. 16. FIG. 19 is a lower rear right perspective view of the male fastener 310 of FIG. 16.

Referring to FIGS. 16-19, the male fastener 210 is identical to the previous male fastener 100 with the addition of a locking member ring 311 formed on the bottom wall 108 of the receiver housing 310. The locking member ring 311 can include raised protrusions 312 with valleys 316 between the protrusions 312. The raised protrusions can have wedge shapes an upwardly sloping outer surfaces.

FIG. 20 is an upper front right perspective view of another female fastener 320 of the rotatable multipositional fastener system 300 used with the male fastener 310 of FIG. 16. FIG. 21 is a lower front right perspective view of the female fastener 320 of FIG. 20. FIG. 22 is an upper right rear perspective view of the female fastener 320 of FIG. 20. FIG. 23 is a lower right rear perspective view of the female fastener 320 of FIG. 20.

Referring to FIGS. 20-23, the female fastener 320 can be similar to the previous female fastener 200 with the with the addition of a locking member ring 321 formed on the top wall 202 of the receiver housing 320. The locking member ring 321 can include raised protrusions 322 with valleys 326 between the protrusions 322. The raised protrusions can have wedge shapes an upwardly sloping outer surfaces.

FIG. 24 is an exploded perspective view of the FIG. 18 male fastener 310 to be attached to the FIG. 20 female fastener 320 and straps 250, 260, 270, 280 about to be fastened to the male fastener 310 and female fastener 320. FIG. 25 is a perspective view of the male fastener 310 and female fastener 320 of FIG. 24 attached together. FIG. 26 is a cross-sectional perspective view of the attached male fastener 310 attached to the female fastener 320 of FIG. 25 along arrows 26X. FIG. 27 is another view of the attached male and female fasteners 310, 320 of FIG. 26 with straps 250-280 shown in FIG. 24 fastened to the receiver housings 310, 320. FIG. 28 is another perspective view of an opposite side of the attached male fastener 310 and female fastener 320 of FIG. 25. FIG. 29 is a right side perspective view of the attached male fastener 310 and female fastener 320 of FIG. 28.

Referring to FIGS. 24-29, the male fastener 310 can attach the female fastener 320 and fasten with straps similar to the male fastener 100 and the female fastener 300, with the addition of locking ring members 311, 321. The locking ring members 311, 321 can be used for locking the first receiver housing (male fastener) 310 to the second receiver housing (female fastener 320) in a selected rotated position.

The male part ring locking member 311 on the bottom wall of the male fastener 310 can include a ring configuration of raised protrusions 312 and valleys 316 between the raised protrusions 312. The female part ring locking member 321 can be located on a top wall of the female fastener 320 and also have raised protrusions 322 and valleys 326 between the raised protrusions 322.

The first receiver housing 310 and the second receiver housing 320 can be initially oriented and rotated to a selected rotated position, followed by the first ring 311 and the second ring 321 are pushed against each other, and are locked together when the raised protrusions 312 of the first ring 311 are mateable with the valleys 326 of the second ring 321, and the raised protrusions 322 of the second ring 321 are mateable with the valleys 316 of the first ring 311.

The rotatable multipositional fastening system can be configured to help secure an item to a mounting surface, and to bundle multiple items while creating the minimal amount of stress on the straps, the receiver housings, and the items being retained by the straps. The multi-positional closure system can be especially effective for fastening multiple straps that approach a corresponding receiver housing while retaining different items, such as large, complex wiring or tubing systems.

For example, the myriad wiring in an aircraft requires a plurality of straps to guide and securely retain the different types and sizes of wires. The insertion tab for each strap must form closures around the wires at various angles; often twisting, torqueing, looping around corners and channels in the aircraft to reach a proximal receiver and achieve the fastening closure. In order for the wires and strap to reach the receivers, twisting, stretching and looping around corners and channels in the aircraft may be necessary to reach the most proximal receiver.

While a preferred embodiment allows for each receiver housing to be formed from single plastic parts, other suitable materials for the receiver housings can include, without limitation, nylon, polyurethane, pliable polymers, aluminum, metal alloys, rubber, and fibers. The fastening system can be used to bundle wires, hoses, and smaller items. Though in one alternative embodiment, a stainless steel version, of the fastener 100, either naked or coated with a rugged plastic, can be used for exterior applications and hazardous environments.

Although the embodiments show and describe a first receiver housing with a male portion being attachable from a second receiver housing with a female slot opening, the invention can have the first receiver with another side wall having a male portion for being attachable to another receiver housing having a female slot portion. Additionally, the second receiver housing can have a male portion on another side wall for allowing the second receiver housing to be attachable to another receiver housing having another a female slot. The receiving housings can have plural male portions and female portions to allow for receiver housings to be attachable and detachable from one another in stacked arrangements similar to the male/female fasteners.

While the receiver housings are shown in generally square box shapes, the receiver housings can have other geometrical shapes, such as but not limited to rectangular box shaped, pyramid box shape, hexagon box shape, and the like. The receiver housings can have eclectic types of numbers, angles, lengths, widths, and diameters.

While the straps are described for example, as including zip ties, the straps can be other types of bundling fastener straps, such as but not limited to include, a zip tie, a cable tie, a wire guide, and a hose tie. Other types of straps can include but are not limited to straps having parallel ridges from one end to another.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A rotatable multi-positional fastening system for fastening a plurality of multi-directional straps, comprising:

a first receiver housing having a plurality of side walls, at least one side wall having an opening for receiving a strap end, and another side wall having an outwardly extending male portion;

a second receiver housing having a plurality of side walls, at least one side wall having an opening for receiving another strap end, and another side wall having a female slot sized to receive the male portion of the first receiver, the second receiver housing oriented in a different plane than the first receiver housing, wherein the male portion of the first receiver housing is attachable and detachable from the female slot in the second receiver housing, so wherein the first receiver housing and the second receiver housing are initially rotatable to one another, wherein the male portion of the first receiver housing includes a base having a semi-hemispherical shape with a stem portion extending outwardly therefrom, the semi-hemispherical shape for allowing rotation of the first receiver housing to the second receiver housing, when the first receiver housing is attached to the second receiver housing; and a fastener associated with each side wall opening in the first receiver housing and the second receiver housing for respectively fastening the strap end and the another strap end.

2. The rotatable multi-positional fastening system of claim 1, wherein the strap end and the another strap end are ends of a plurality of straps.

3. The rotatable multi-positional fastening system of claim 2, wherein the plurality of straps includes zip ties.

4. The rotatable multi-positional fastening system of claim 1, wherein the strap end and the another strap end are ends of one strap.

5. The rotatable multi-positional fastening system of claim 4, wherein the one strap includes at least one zip tie.

6. The rotatable multi-positional fastening system of claim 1, wherein the first receiver housing and the second receiver housing includes at least one tapered sidewall.

7. The rotatable multi-positional fastening system of claim 1, wherein the first receiver housing and the second receiver housing, each have a generally box shape.

8. The rotatable multi-positional fastening system of claim 1, wherein the female slot in the second receiver housing includes:

a bowl shape with a through hole in the bottom of the bowl shape for allowing a portion of the stem portion to pass therethrough and the semi-hemispherical shape being able to rotate in the bowl shape.

9. The rotatable multi-positional fastening system of claim 8, wherein the second receiver includes:

an arm with a clamp, wherein the clamp is attachable to wrap about a side groove on the stem portion, the clamp allowing the first receiver housing and the second receiver housing to remain attached to one another, and wherein removing the clamp from the side groove allows the first receiver housing and the second receiver housing to detach from one another.

10. The rotatable multi-positional fastening system of claim 1, wherein the first receiver housing is formed as single molded plastic part, and the second receiver housing is formed as a single molded plastic part.

11. The rotatable multi-positional fastening system of claim 1, wherein the first receiver housing further includes:

side openings on opposite side walls so that a strap can pass through both of the openings.

12. The rotatable multi-positional fastening system of claim 11, wherein the first receiver housing further includes:

a top opening on the first receiver housing opposite to the sidewall having the male portion extending therefrom.

13. The rotatable multi-positional fastening system of claim 1, wherein the second receiver housing further includes:

a second side opening on another side wall perpendicular to the female slot.

14. A rotatable multi-positional fastening system for fastening a plurality of multi-directional straps, comprising:

two receivers disposed adjacently to one another, each receiver defined by a housing and at least one opening;

a male part and a female part for attaching the two receivers together, wherein the male part includes a base having a semi-hemispherical shape with a stem portion extending outwardly therefrom, the semi-hemispherical shape for allowing rotation of the two receivers relative to one another, when the two receivers are attached together, a fastener for attaching a portion of a strap to the at least one opening in each of the two receivers, wherein, the two receivers are at least initially rotatable with one another.

15. The rotatable multi-positional fastening system of claim 14, wherein the female part includes:

a bowl shape with a through hole in the bottom of the bowl shape for allowing a portion of the stem portion to pass therethrough, and the semi-hemispherical shape being able to rotate in the bowl shape.

16. A rotatable multi-positional fastening system for fastening a plurality of multi-directional straps, comprising:

receivers disposed adjacently to one another, each receiver defined by a housing and at least one opening;

a male portion and a female portion for attaching the receivers together, wherein the male portion has a base with a semi-hemispherical shape and a stem portion extending outwardly therefrom, the semi-hemispherical shape portion for allowing rotation of the receivers to one another, when the receivers are attached together, and wherein the female portion includes a bowl shape with a through hole in the bottom of the bowl shape for allowing a portion of the stem portion to pass therethrough, and the semi-hemispherical shape being able to rotate in the bowl shape, a fastener for attaching a portion of a strap to the at least one opening in each of the receivers, wherein, the receivers are at least initially rotatable with one another.

* * * * *